US005705761A

United States Patent [19]

Minamitaka

[11] Patent Number: 5,705,761

[45] Date of Patent: Jan. 6, 1998

[54] MACHINE COMPOSER FOR ADAPTING PITCH SUCCESSION TO MUSICAL BACKGROUND

[75] Inventor: Junichi Minamitaka, Musashimurayama, Japan

[73] Assignee: Casio Computer Co., Ltd., Tokyo, Japan

[21] Appl. No.: 706,164

[22] Filed: Aug. 30, 1996

[30] Foreign Application Priority Data

Sep. 11, 1995 [JP] Japan ..... 7-257266

[51] Int. Cl.[6] ..... G10H 1/22; G10H 1/38

[52] U.S. Cl. ..... 84/609; 84/613; 84/618; 84/DIG. 2; 84/DIG. 22

[58] Field of Search ..... 84/604–614, 634–638, 84/649–652, 666–669, DIG. 22, 618, 656, DIG. 2; 395/2.16, 2.17; 434/307 A, 308

[56] References Cited

U.S. PATENT DOCUMENTS

| | | | |
|---|---|---|---|
| 4,926,737 | 5/1990 | Minamitaka . | |
| 5,179,241 | 1/1993 | Okuda et al. . | |
| 5,296,643 | 3/1994 | Kuo et al. | 84/610 |
| 5,375,501 | 12/1994 | Okuda . | |
| 5,428,708 | 6/1995 | Gibson et al. | 395/2.16 X |
| 5,446,238 | 8/1995 | Koyama et al. | 84/669 |
| 5,451,709 | 9/1995 | Minamitaka . | |
| 5,477,003 | 12/1995 | Muraki et al. | 84/610 |

FOREIGN PATENT DOCUMENTS

| | | |
|---|---|---|
| 54-48223 | 4/1979 | Japan . |
| 4-9892 | 1/1992 | Japan . |
| 8-76759 | 3/1996 | Japan . |
| 8-160949 | 6/1996 | Japan . |

*Primary Examiner*—Stanley J. Witkowski
*Attorney, Agent, or Firm*—Frishauf, Holtz, Goodman, Langer Chick, P.C.

[57] ABSTRACT

To provide a machine composer capable of efficiently composing natural melodies with a simplified system configuration and without requiring complicated data processing: A melody material storage 10 stores a plurality of melody materials each represented by a plurality of note records. Each note record in a melody material contains data items of pitch and note type or function. Thus, pitches of the plurality of note records constitute an original pitch succession whereas note types of the records define an original note type succession. A note type of each note record represents a pitch function specified by musical background of the original pitch succession. A input device 20 enters musical background information (including for example keynote, scale and chord). A pitch adapter 30 successively makes adapted pitches based on the entered musical background information and based on pitch and note type data from the melody material storage 10 to thereby compose a musical pitch succession or melody that is adapted to the entered musical background and depends on the original pitch and note type succession.

18 Claims, 29 Drawing Sheets

FIG.3

1. CHORD TYPE

| NAME | NUMERIC |
|---|---|
| MAJ | 0 |
| MIN | 1 |
| 7TH | 2 |
| M7 | 3 |

2. SCALE

| NAME | NUMERIC |
|---|---|
| DIATONIC | 0 |
| DORIAN | 1 |

3. ROOT/KEY

| NAME | NUMERIC |
|---|---|
| C | 0 |
| C# | 1 |
| D | 2 |
| E♭ | 3 |
| E | 4 |
| F | 5 |
| F# | 6 |
| G | 7 |
| A♭ | 8 |
| A | 9 |
| B♭ | 10 |
| B | 11 |

4. NOTE TYPE

| NAME | NUMERIC |
|---|---|
| CT:CHORD TONE | 0 |
| AN:AVAILABLE NOTE | 1 |
| SN:SCALE NOTE | 2 |
| TN:TENSION NOTE | 3 |
| AV:AVOID NOTE | 4 |

5. ROOT/TYPE

| NAME | NUMERIC |
|---|---|
| ROOT | 0 |
| TYPE | 1 |

FIG.4 ctDB[ ]

| | | | | | | | | | | | | | | | | |
|---|---|---|---|---|---|---|---|---|---|---|---|---|---|---|---|---|
| * | * | * | * | 0 | 0 | 0 | 0 | 1 | 0 | 0 | 1 | 0 | 0 | 0 | 1 | MAJ(C,E,G) |
| * | * | * | * | 0 | 0 | 0 | 0 | 1 | 0 | 0 | 0 | 1 | 0 | 0 | 1 | MIN(C,E♭,G) |
| * | * | * | * | 0 | 1 | 0 | 0 | 1 | 0 | 0 | 1 | 0 | 0 | 0 | 1 | 7TH(C,E,G,B♭) |
| * | * | * | * | 1 | 0 | 0 | 0 | 1 | 0 | 0 | 1 | 0 | 0 | 0 | 1 | M7(C,E,G,B) |
| * | * | * | * | 1 | 1 | 1 | 1 | 1 | 1 | 1 | 1 | 1 | 1 | 1 | 1 | NC |

tnDB[ ]

| | | | | | | | | | | | | | | | | |
|---|---|---|---|---|---|---|---|---|---|---|---|---|---|---|---|---|
| * | * | * | * | 0 | 0 | 1 | 0 | 0 | 1 | 0 | 0 | 0 | 1 | 0 | 0 | MAJ(9,♯11,13) |
| * | * | * | * | 0 | 0 | 0 | 0 | 0 | 0 | 1 | 0 | 0 | 1 | 0 | 0 | MIN(9,11) |
| * | * | * | * | 0 | 0 | 1 | 1 | 0 | 0 | 0 | 0 | 1 | 1 | 1 | 0 | 7TH(♭9,9,♯9,♭13,13) |
| * | * | * | * | 0 | 0 | 1 | 0 | 0 | 1 | 0 | 0 | 0 | 1 | 0 | 0 | M7(9,♯11,13) |
| * | * | * | * | 1 | 1 | 1 | 1 | 1 | 1 | 1 | 1 | 1 | 1 | 1 | 1 | NC |

snDB[ ]

| | | | | | | | | | | | | | | | | |
|---|---|---|---|---|---|---|---|---|---|---|---|---|---|---|---|---|
| * | * | * | * | 1 | 0 | 1 | 0 | 1 | 0 | 1 | 1 | 0 | 1 | 0 | 1 | DIATONIC(C,D,E,F,G,A,B) |
| * | * | * | * | 0 | 1 | 1 | 0 | 1 | 0 | 1 | 0 | 1 | 1 | 0 | 1 | DORIAN(C, D,E♭,F,G,A,B♭) |
| * | * | * | * | 1 | 1 | 1 | 1 | 1 | 1 | 1 | 1 | 1 | 1 | 1 | 1 | NS |

FIG.5 pDB[ ]

| |
|---|
| DATA OF NOTE #1 |
| DATA OF NOTE #2 |
| · |
| · |
| · |
| END |

101

| |
|---|
| NOTE-ON TIME pDB[np×5] |
| DURATION pDB[np×5+1] |
| VELOCITY pDB[np×5+2] |
| PITCH pDB[np×5+3] |
| NOTE TYPE pDB[np×5+4] |

102

| |
|---|
| 0 |
| 480 |
| 100 |
| 60(C4) |
| 0(CHORD TONE) |
| 480 |
| 480 |
| 100 |
| 62(D4) |
| 1(AVAILABLE NOTE) |
| 960 |
| 480 |
| 100 |
| 64(E4) |
| 0(CHORD TONE) |

FIG.8

1. key:KEYNOTE OR TONIC

| |
|---|
| key |

2. scale:NOTE SCALE

| |
|---|
| scale |

3. nt:NOTE TYPE OR FUNCTION

| |
|---|
| nt |

4. pit:PITCH

| |
|---|
| pit |

5. pccnt:PITCH CANDIDATE COUNTER

| |
|---|
| pccnt |

6. cp/mp/pp:CHORD / COMPOSED MELODY / MATERIAL POINTERS

| |
|---|
| cp/mp/pp |

7. me[ ]:COMPOSED MELODY

| |
|---|
| NOTE-ON TIME |
| DURATION |
| VELOCITY |
| PITCH |
| |
| |
| |
| |
| |
| |
| |
| |

8. chord[ ]:CHORD

| |
|---|
| chord[0] (ROOT) |
| chord[1] (TYPE) |

9. cflag,sflag:FLAGS

| |
|---|
| cflag,sflag |

FIG.12

| |
|---|
| 0 |
| 240(EIGHTH NOTE) |
| 100(VELOCITY) |
| 60(C4) |
| 0(CT) |
| 240 |
| 240(EIGHTH NOTE) |
| 100(VELOCITY) |
| 62(D4) |
| 1(AN) |
| 480 |
| 240(EIGHTH NOTE) |
| 100(VELOCITY) |
| 64(E4) |
| 0(CT) |
| 720 |
| 240(EIGHTH NOTE) |
| 100(VELOCITY) |
| 65(F4) |
| 2(SN) |
| 960 |
| 240(EIGHTH NOTE) |
| 100(VELOCITY) |
| 67(G4) |
| 0(CT) |
| 1919 |
| 0( ) |
| 0( ) |
| 0( ) |
| ffffH(END) |

FIG.13

| ORIGINAL PITCH OF MATERIAL | FIRST P-CANDIDATE | SECOND P-CANDIDATE | THIRD P-CANDIDATE |
|---|---|---|---|
| C4(CT) | C4(CT) | – | – |
| D4(AN) | D4(AN) | – | – |
| E4(CT) | E4(CT) | – | – |
| F4(SN) | F4(AV) | F#4(AN) | – |
| G4(CT) | G4(CT) | – | – |

FIG.14

| ORIGINAL PITCH OF MATERIAL | FIRST P-CANDIDATE | SECOND P-CANDIDATE | THIRD P-CANDIDATE |
|---|---|---|---|
| C4(CT) | C4(AV) | C♯4(AN) | B3(CT) |
| D4(AN) | D4(SN) | E♭4(AV) | C♯4(AN) |
| E4(CT) | E4(CT) | – | – |
| F4(SN) | F4(AV) | F♯4(AN) | – |
| G4(CT) | G4(AV) | A♭4(CT) | – |

FIG.15

| |
|---|
| 0 |
| 240(EIGHTH NOTE) |
| 100(VELOCITY) |
| 60(C4) |
| 0(CT) |
| 240 |
| 240(EIGHTH NOTE) |
| 100(VELOCITY) |
| 62(D4) |
| 1(AN) |
| 480 |
| 240(EIGHTH NOTE) |
| 100(VELOCITY) |
| 65(F4) |
| 2(SN) |
| 720 |
| 240(EIGHTH NOTE) |
| 100(VELOCITY) |
| 66(F#4) |
| 3(TN) |
| 960 |
| 240(EIGHTH NOTE) |
| 100(VELOCITY) |
| 68(G#4) |
| 4(AV) |
| 1919 |
| 0( ) |
| 0( ) |
| 0( ) |
| ffffH(END) |

FIG.16

| ORIGINAL PITCH OF MATERIAL | FIRST P-CANDIDATE | SECOND P-CANDIDATE | THIRD P-CANDIDATE |
|---|---|---|---|
| C4(CT) | C4(SN) | C♯4(AN) | B3(CT) |
| D4(AN) | D4(SN) | E♭4(AV) | C♯4(AN) |
| F4(SN) | F4(SN) | – | – |
| F♯4(TN) | F♯4(AN) | – | – |
| G♯4(AV) | G♯4(CT) | – | – |

FIG.18

| |
|---|
| 0 |
| 240(EIGHTH NOTE) |
| 100(VELOCITY) |
| 60(C4) |
| 0(CT) |
| 240 |
| 240(EIGHTH NOTE) |
| 100(VELOCITY) |
| 62(D4) |
| 1(AN) |
| 480 |
| 240(EIGHTH NOTE) |
| 100(VELOCITY) |
| 65(F4) |
| 2(SN) |
| 720 |
| 240(EIGHTH NOTE) |
| 100(VELOCITY) |
| 66(F#4) |
| 3(TN) |
| 960 |
| 240(EIGHTH NOTE) |
| 100(VELOCITY) |
| 68(G#4) |
| 4(AV) |
| 1919 |
| 0( ) |
| 0( ) |
| 0( ) |
| ffffH(END) |

FIG.19

| ORIGINAL MATERIAL | FIRST P-CANDIDATE | SECOND P-CANDIDATE | THIRD P-CANDIDATE |
|---|---|---|---|
| C4(CT) | C4(AV) | C#4(AN) | – |
| D4(AN) | D4(AN) | – | – |
| F4(SN) | F4(AV) | F#4(AN) | – |
| F#4(TN) | F#4(AN) | – | – |
| G#4(AV) | G#4(AN) | – | – |

FIG.21 ctDB[ ]

| | | | | | | | | | | | | | | | | |
|---|---|---|---|---|---|---|---|---|---|---|---|---|---|---|---|---|
| * | * | * | * | 0 | 0 | 0 | 0 | 1 | 0 | 0 | 1 | 0 | 0 | 0 | 1 | MAJ(C,E,G) |
| * | * | * | * | 0 | 0 | 0 | 0 | 1 | 0 | 0 | 0 | 1 | 0 | 0 | 1 | MIN(C,E♭,G) |
| * | * | * | * | 0 | 1 | 0 | 0 | 1 | 0 | 0 | 1 | 0 | 0 | 0 | 1 | 7TH(C,E,G,B♭) |
| * | * | * | * | 1 | 0 | 0 | 0 | 1 | 0 | 0 | 1 | 0 | 0 | 0 | 1 | M7(C,E,G,B) |

tnDB[ ]

| | | | | | | | | | | | | | | | | |
|---|---|---|---|---|---|---|---|---|---|---|---|---|---|---|---|---|
| * | * | * | * | 0 | 0 | 1 | 0 | 0 | 1 | 0 | 0 | 0 | 1 | 0 | 0 | MAJ(9,♯11,13) |
| * | * | * | * | 0 | 0 | 0 | 0 | 0 | 0 | 1 | 0 | 0 | 1 | 0 | 0 | MIN(9,11) |
| * | * | * | * | 0 | 0 | 1 | 1 | 0 | 0 | 0 | 0 | 1 | 1 | 1 | 0 | 7TH(♭9,9,♯9,♭13,13) |
| * | * | * | * | 0 | 0 | 1 | 0 | 0 | 1 | 0 | 0 | 0 | 1 | 0 | 0 | M7(9,♯11,13) |

snDB[ ]

| | | | | | | | | | | | | | | | | |
|---|---|---|---|---|---|---|---|---|---|---|---|---|---|---|---|---|
| * | * | * | * | 1 | 0 | 1 | 0 | 1 | 0 | 1 | 1 | 0 | 1 | 0 | 1 | DIATONIC(C,D,E,F,G,A,B) |
| * | * | * | * | 0 | 1 | 1 | 0 | 1 | 0 | 1 | 0 | 1 | 1 | 0 | 1 | DORIAN(C, D,E♭,F,G,A,B♭) |

9–14M
COMPOSE MELODY
22–1
INITIALIZE NOTE POINTER : pp = 0, mp = 0
22–2
SEARCH FOR PREVAILING CHORD
22–3
pccnt = 0, pit = pDB[pp+3] pDB[pp–2]+me[mp–1]
NO
22–4
IDENTIFY AND CHECK NOTE TYPE
OK
NG
22–5
GENERATE NEXT PITCH CANDIDATE : pit = pit+pc[pccnt]
22–7
22–6
pccnt < 5
YES
pccnt = pccnt+1
NO
22–8
pit = pDB[pp+3]
22–9
me[mp] = pDB[pp], me[mp+1] = pDB[pp+1]
22–10
me[mp+2] = pDB[pp+2], me[mp+3] = pit
22–11
UPDATE NOTE POINTER : pp = pp+5, mp = mp+4
22–12
CONTINUE? : pDB[pp+4] < ffffH
YES
NO
RET

FIG.23

| |
|---|
| 0 |
| 240(EIGHTH NOTE) |
| 100(VELOCITY) |
| 60(C4) |
| 0(CT) |
| 240 |
| 240(EIGHTH NOTE) |
| 100(VELOCITY) |
| 62(D4) |
| 1(AN) |
| 480 |
| 240(EIGHTH NOTE) |
| 100(VELOCITY) |
| 65(F4) |
| 2(SN) |
| 720 |
| 240(EIGHTH NOTE) |
| 100(VELOCITY) |
| 66(F#4) |
| 3(TN) |
| 960 |
| 240(EIGHTH NOTE) |
| 100(VELOCITY) |
| 68(G#4) |
| 4(AV) |
| 1919 |
| 0( ) |
| 0( ) |
| 0( ) |
| ffffH(END) |

FIG.24

| ORIGINAL MATERIAL | FIRST P-CANDIDATE | SECOND P-CANDIDATE | THIRD P-CANDIDATE |
|---|---|---|---|
| C4(CT) | C4(AV) | C#4(SN) | – |
| D4(AN) | D#4(AV) | E4(SN) | – |
| F4(SN) | G4(AV) | G#4(SN) | – |
| F#4(TN) | A4(SN) | – | – |
| G#4(AV) | B4(SN) | – | – |

FIG.25

| MATERIAL DATABASE HEADER DB[ ] | |
|---|---|
| | ADDRESS POINTER TO MELODY MATERIAL #1 |
| | KEY OF MELODY MATERIAL #1 |
| | SCALE OF MELODY MATERIAL #1 |
| | ADDRESS POINTER TO MELODY MATERIAL #2 |
| | KEY OF MELODY MATERIAL #2 |
| | SCALE OF MELODY MATERIAL #2 |
| | · |
| | · |
| | · |
| | END |

| MELODY MATERIAL pDB[ ] | |
|---|---|
| | DATA OF NOTE #1 |
| | DATA OF NOTE #2 |
| | · |
| | · |
| | · |
| | END |

| DATA PER NOTE "NOTE" | |
|---|---|
| | NOTE-ON TIME pDB[np×5] |
| | DURATION pDB[np×5+1] |
| | VELOCITY pDB[np×5+2] |
| | PITCH pDB[np×5+3] |
| | NOTE TYPE pDB[np×5+4] |

| DATA EXAMPLE EX | |
|---|---|
| | 0 |
| | 480 |
| | 100 |
| | 60(C4) |
| | 0(CHORD TONE) |
| | 480 |
| | 480 |
| | 100 |
| | 62(D4) |
| | 1(AVAILABLE NOTE) |
| | 960 |
| | 480 |
| | 100 |
| | 64(E4) |
| | 0(CHORD TONE) |

MACHINE COMPOSER FOR ADAPTING PITCH SUCCESSION TO MUSICAL BACKGROUND

BACKGROUND OF THE INVENTION

This invention relates generally to musical apparatus and in particular pertains to a machine composer for composing music such as a melody.

Machine composers which compose melodies are known.

For example, U.S. Pat. No. 4,926,737, assigned to the same assignee as the present application, discloses a machine composer which uses an input motive to make melody characteristic parameters, and composes a melody following the motive based on the melody characteristic parameters and a chord progression. This machine composer can compose a melody in which a motive feature is reflected. However it requires a large mount of and complicated data processing. Also the efficiency of composing a real and natural melody is relatively low.

U.S. Pat. No. 5,375,501, assigned to the same assignee as the present application, has proposed a machine melody composer which composes a melody on a phrase-by-phrase basis. The machine composer comprises a phrase database that stores many and various phrases each represented by a note type succession and a note durational succession. A melody generating index database stores records of melody generating index. Each record describes musical background (e.g., keynote and chord progression) and how phrases from the phrase database are concatenated into a melody. In operation, a desired generating index record is selected from the generating index database. According to the description of the selected melody generating index record, a phrase is retrieved from the phrase database and a note type succession of the phrase is transformed into a pitch succession. This composer can efficiently provide a natural melody formed with a chain of phrases.

However, the machine composer of U.S. Pat. No. 5,375,501 requires massive storage capacity so that the circuit scale or size of the apparatus will become very large. In addition, transforming a phrase note type succession into a pitch succession is performed based on a previous pitch preceding that phrase (reference pitch) and musical background of that phrase (as described in the melody generating index record). Thus, for a particular reference pitch and a particular musical background, the composer can only compose a single particular pitch succession. In other words, one-to-one correspondence exists between note type successions and pitch successions once a reference pitch and a musical background have been specified.

SUMMARY OF THE INVENTION

It is, therefore, an object of the invention is to provide a machine composer which can efficiently compose a natural musical note succession constituting a melody or the like without requiring complicated data processing or a massive storage system.

In accordance with the invention, there is provided a machine composer for music which comprises:

music material storage means for storing data of a musical note succession represented by a plurality of note data records in which each note data record includes at least a note type and a pitch;

background input means for inputting musical background information; and pitch adapting means for changing a pitch of said each note data record from said music material storage means into an adapted pitch based on pitch and note type included in the note data record and based on said input musical background information to thereby make a pitch succession adapted to the input musical background.

In this arrangement, each note data record in the music material storage means not only includes a note type but also includes a pitch. Pitches of the plurality of note data records constitute an original, or stored pitch succession which is considered, of course, natural and real. A note type of each note data record represents a pitch function specified by musical background of the stored musical note succession. On the other hand, the background input means enters musical background information desired by a user. The entered musical background information can happen to be identical with the musical background of the original musical note succession stored in the music material storage means but differs generally. The pitch adapting means changes a pitch of each note data record into a pitch that is adapted to the entered musical background information. Specifically, the pitch adapting means changes a pitch of each note data record (original or stored pitch) into an adapted pitch based on stored pitch and note type of the note data record and the entered musical background information to thereby make or compose a pitch succession adapted to the entered musical background. It is also noted in the principles of the invention that the composed pitch succession depends on the original or stored pitch and note type succession.

Therefore, the function of the pitch adapting means is expected not to drastically change or destroy musicality of the original or stored pitch succession but to correct or adjust the original pitch succession to the one adapted to the entered musical background. As a result, the present machine composer can efficiently compose a natural and real pitch succession or melody.

The background input means may comprise means for inputting, as the musical background information, a keynote, a note scale and a chord progression.

In the alternative, the background input means may comprise means for selectively inputting, as the musical background information, (A) a keynote, a note scale and a chord progression, (B) a keynote and a note scale, or (C) a chord progression only.

In a preferred embodiment, the pitch adapting means comprises:

pitch candidate generating means for successively generating a plurality of different pitch candidates, one at a time, based on a pitch (original pitch) stored in said music material storage means;

note type identifying means for identifying a note type of a pitch candidate from said pitch candidate generating means based on the input musical background information;

comparing means for comparing the identified note type of the pitch candidate with the note type of the original pitch stored in said music material storage means; and pitch determining means for determining whether the pitch candidate is adapted based on results of said comparing and for requesting the pitch candidate generating means to generate a next pitch candidate when said pitch candidate has been found unadapted.

The pitch candidate generating means may comprise:

pitch difference table storage means for storing a plurality of pitch differences that are successively readable; and computing means for using a pitch (original pitch) from said music material storage means and pitch difference or differences from the pitch difference table storage means to thereby compute a pitch candidate.

The computing means may comprise:

motion determining means for determining a motion between an original pitch and a previous pitch from the musical material storage means; and arithmetic means for selectively adding to or subtracting from the original pitch a pitch difference or differences from the pitch difference table depending on the determined motion to thereby generate a pitch candidate.

In the alternative, the pitch candidate generating means may comprise:

a plurality of different pitch difference table storage means each for storing a plurality of pitch differences that are successively readable;

selecting means for selecting a desired one of the plurality of different pitch difference table storage means; and computing means for using a pitch (original pitch) from the music material storage means and pitch difference or differences from the selected pitch difference table to thereby compute a pitch candidate.

The pitch candidate generating means may further comprise initial means for using a pitch (original pitch) stored in said music material storage means as an initial pitch candidate. With this initial means (and a pitch difference table storage for supplying a succession of absolute-increasing pitch differences, +1, −1, +2, −2, +3, −3 etc., one at a time), the pitch adapting means makes a pitch succession that is adapted to the input musical background information and as close as possible or closest to an original pitch succession constituted by pitches of the plurality of note data records.

In the alternative, the pitch candidate generating means may comprise initial means for generating an initial pitch candidate by adding to a previous adapted pitch a pitch interval from a previous to current original pitch stored in said musical material storage means. With this initial means (and a succession of absolute-increasing pitch differences), the pitch adapting means makes a pitch succession that is adapted to the input musical background information and has a pitch difference succession as close as possible to a pitch difference succession of an original pitch succession constituted by pitches of the plurality of note data records.

In a preferred embodiment, a note type of each note data records in the music material storage means has been preselected from note types including chord tone, available note, scale note, tension note and avoid note.

In a preferred embodiment, the note type identifying means may comprise:

chord tone pitch class set determining means for determining a chord tone pitch class set for a chord from the input musical background information;

tension note pitch class set determining means for determining a tension note pitch class set for the chord from the input musical background information;

scale note pitch class set determining means for determining a scale note pitch class set for a scale and keynote from the input musical background information; and matching means for matching a pitch class of the pitch candidate against the determined chord tone pitch class set, the determined tension note pitch class set and the determined scale note pitch class set, respectively, to thereby identifying the note type of the pitch candidate as a function of the input musical background.

In a preferred embodiment, the comparing means comprises:

priority assigning means for assigning unique priorities to different ones of a plurality of note types; and priority comparing means for comparing a priority assigned to the identified note type with a priority assigned to the note type stored in said music material storage means; and wherein the pitch determining means comprises means for accepting said pitch candidate as an adapted pitch when the priority comparing means has found that the priority assigned to the identified note type is higher than or equal to the priority assigned to the note type stored in said music material storage means.

In a preferred embodiment, the background input means comprises input means for selectively inputting, as the musical background information, (A) a plurality of features of musical background, or (B) a part of the plurality of features. The pitch adapting means comprises:

pitch candidate generating means for successively generating a plurality of different pitch candidates, one at a time, based on a pitch stored in the music material storage means;

note type identifying means for identifying a note type of a pitch candidate from the pitch candidate generating means based on the input musical background information;

first pitch determining means operative when the plurality of features have been input for determining that the pitch candidate is adapted on the condition that a first relation holds between the identified note type of the pitch candidate and the note type stored in the music material storage means;

second pitch determining means operative when the part has been input for determining that the pitch candidate is adapted on the condition that a second relation different from the first relation holds between the identified note type and the note type stored in the music material storage means; and next means operative when either the first or second pitch determining means has found the pitch candidate unadapted for requesting the pitch candidate generations means to generate a next pitch candidate.

In a preferred embodiment, each note data record in the music materials storage means further includes a note-on-time a duration and velocity as well as a note type and a pitch.

In another embodiment, the machine composer further comprises: background storage means for storing keynote and scale information concerning said musical note succession stored in said musical material storage means; and substituting means for substituting the stored keynote and scale information when the input musical background information does not contain a keynote or a scale.

The pitch adapting means may be implemented by a look up table memory system if the storage capacity has no program. Such a look up table memory system receives pitch and note type data from music material storage means, as first and second arguments, receives the entered music background information as third argument and returns adapted pitch data.

It is convenient here to define terms used in the specification and the claims. The term "musical background" refers to those features or aspects of music which support a musical note or pitch succession or melody, or provide a musical context thereto. Unlike the musical note succession, the musical background does not stay on the foreground or music surface (e.g., not directly or constantly sounded). For example, a key signature that is not heard at all is a feature of musical background. A keynote or tonic that plays a very important role in a pitch succession is a feature of musical background. A chord that harmonically supports a pitch succession or melody is another feature of the musical background. A tonality that essentially determines pitch collection or pitch class set of a musical note succession is also a feature of musical background. The term "note type" (of a pitch) refers to a pitch function specified by musical background of a musical pitch succession or melody including that pitch. The term "tension note" generally refers to a note, sound of which provides a sense of suspension or tension when sounded simultaneously with chord tones. The tension note may be regarded as an extension of chord tones. In a preferred embodiment, a tension note pitch class set is determined by a chord whereas a chord tone pitch class set is also determined by the chord. The term "pitch class" refers to a pitch name deprived of an octave, such as C, C♯, etc. The term "pitch succession" or "musical note succession" does not necessarily mean a single pitch or note at a time and another pitch at another or next time and so on. The pitch succession may include a pause or rest (temporary absence of sound). The pitch succession may include a plurality of pitches sounded simultaneously. The term "chord progression" refers generally to a succession of chords but may include a single chord only (depending on a music or melody material involved which may be short enough to be harmonized by a single chord).

A pitch succession composed by the machine composer of the invention may be performed by any suitable automatic music performing apparatus including a tone generator or synthesizer. Such an automatic performing apparatus may use the composed pitch succession as a "melody" part or an "accompaniment" part.

BRIEF DESCRIPTION OF THE DRAWINGS

The above and other objects, features and advantages of the invention will become more apparent from the following description taken in conjunction with the drawings in which:

FIG. 3 shows numeric representation of respective musical elements used in an embodiment of the invention;

FIG. 4 shows a standard pitch class set storage;

FIG. 5 shows a melody material storage;

FIG. 8 shows a variable list used in the embodiment of the invention;

FIG. 12 illustrates melody material data;

FIG. 13 shows results of composing operation, obtained from the melody material data in FIG. 12 when executing the routines shown in FIGS. 10 and 11 in a first condition of entered musical background;

FIG. 14 shows results of composing operation, obtained from the melody material data in FIG. 12 when executing the routines shown in FIGS. 10 and 11 in a second condition of entered musical background;

FIG. 15 illustrates melody material data;

FIG. 16 shows results of composing operation, obtained from the melody material data in FIG. 15 when executing the routines shown in FIGS. 10 and 11;

FIG. 18 illustrates melody material data;

FIG. 19 shows a result of composing operation, obtained from the melody material data in FIG. 18 when executing the routines shown in FIGS. 10 and 17;

FIG. 21 is a modification of the standard pitch class set storage;

FIG. 23 illustrates melody material data;

FIG. 24 shows results of composing operation, obtained from the melody material data in FIG. 23, when executing the routine shown in FIG. 22;

FIG. 25 shows a melody material database in which each melody material data entity includes keynote and note scale information;

DETAILED DESCRIPTION OF PREFERRED EMBODIMENTS

The invention will now be described in greater detail with respect to preferred embodiments.

Figure 1:
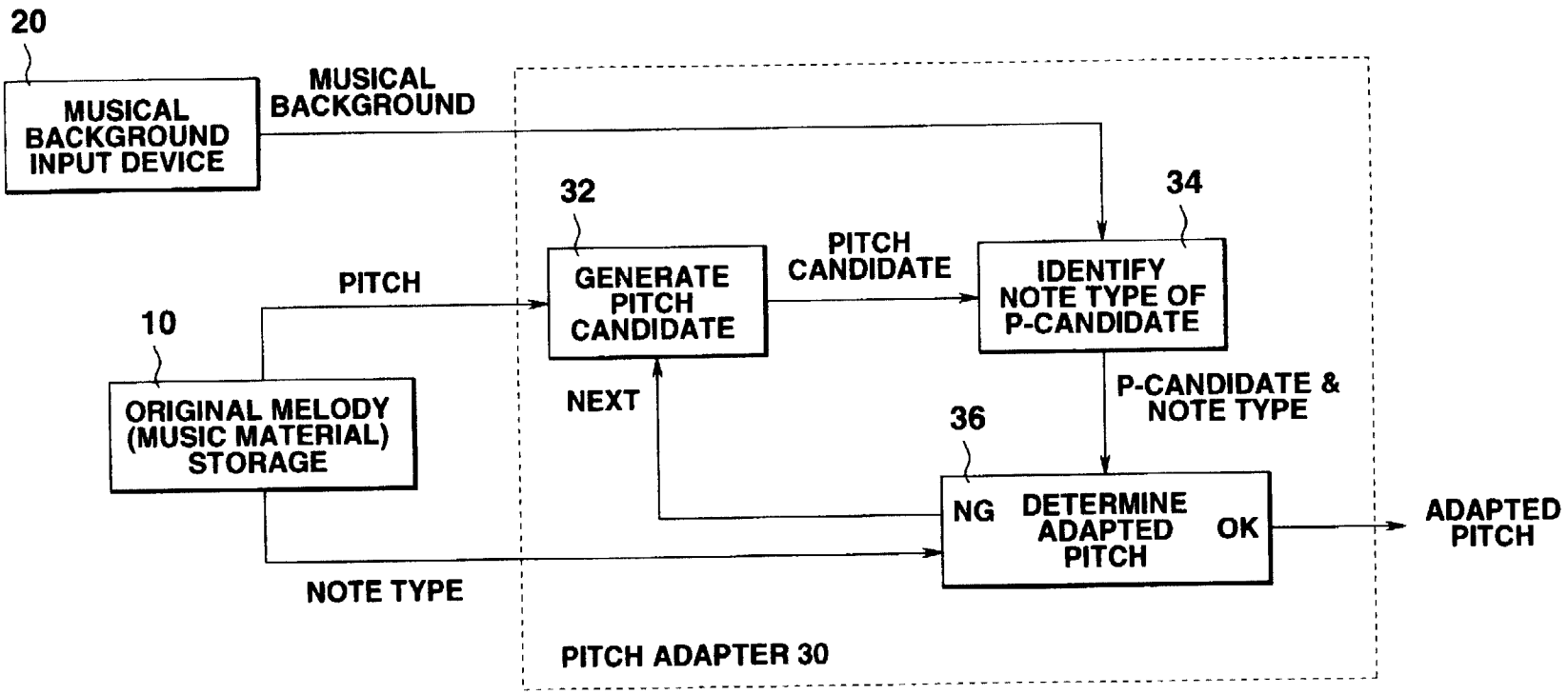
FIG. 1 is a function block diagram of a machine composer in the accordance with the invention.

Referring first to FIG. 1, there is shown a function block diagram of a machine composer in accordance with the invention. In FIG. 1, a melody material storage 10 stores a succession of musical notes, forming an original melody, and represented by a plurality of note data records in which each note data record includes at least a note function or type and pitch of the note. The data stored in the storage 10 is called melody material, original melody or melody material data. An input device 20 enters musical background information. As the musical background information, the input device 20 may selectively enter (a) keynote, note scale and chord progression, (b) keynote and scale or (c) chord progression only.

A pitch adapter 30 changes each note pitch from the melody material data based on note type and pitch stored in the melody material storage 10, and musical background information entered from the input device 20. The illustrated pitch adapter 30 comprises a pitch candidate generating module 32 for generating a polarity of different pitch candidates, one at a time, based on or as a function of a stored pitch in the melody material storage, a note type determining module 34 for identifying a note type or function of the generated pitch candidate based on and specified by the musical background information entered, and a pitch determining module 36 for comparing the identify note type of the pitch candidate with stored original note type in the melody material storage 10 to thereby determine whether the pitch candidate is adapted to the entered musical background information. In the affirmative, pitch determining module 36 outputs the pitch candidate as an adapted pitch. In the negative the pitch determining module 36 requests the pitch candidate generating module 32 to generate a next pitch candidate. As a result, pitch determining module 36 composes an adapted pitch succession which is a function of the original pitch succession stored in the melody material storage 10 and which is adapted to the musical background information entered from the input device 20.

Figure 2:
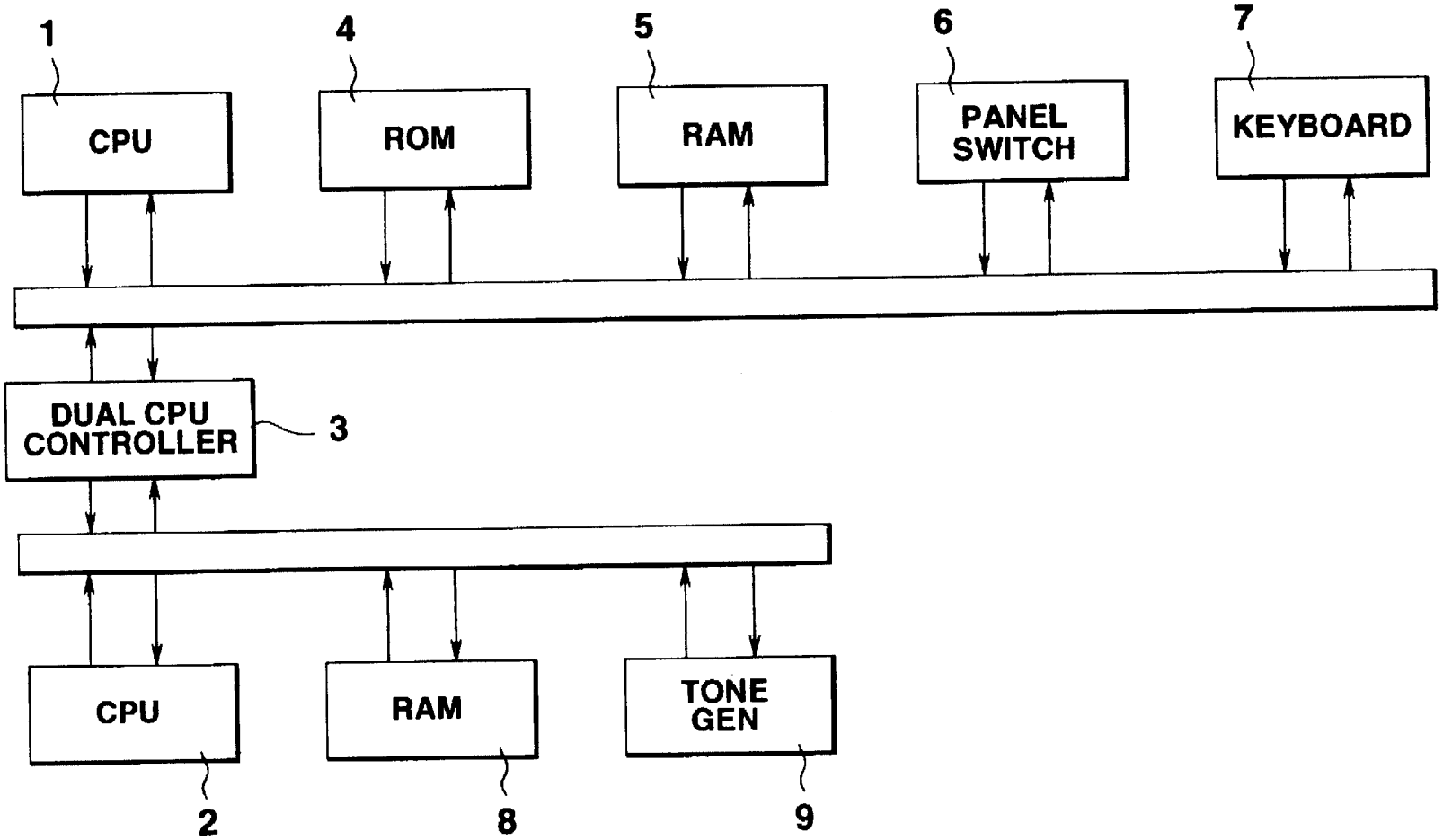
FIG. 2 is a block diagram of a hardware arrangement of an electronic musical instrument in cooperating machine composer features of the invention.

FIG. 2 is a block diagram of a hardware arrangement of an electronic keyboard instrument incorporating machine composer features of the invention. In FIG. 2, a first CPU 1 executes all processes except for controlling a tone generator 9, controlling of which is done by a second CPU 2. A dual CPU controller 3 is a controller which provides an interface between the first and second CPUs 1 and 2. ROM 4 stores programs and data. RAM 5 is used by CPU 1 as a temporal storage. A panel switch 6 includes a plurality of switches and keys arranged on an instrument control panel. A musical keyboard 7 includes an array of keys like piano or organ keys to be played by a player. RAM 8 is used by CPU 2 as a temporal storage. A tone generator 9 electronically generates a musical sound signal under the control of CPU 2.

FIG. 3 illustrates numeric representations or allocations of respective musical elements. Chord types, major "MAJ", minor "MIN", seventh "7TH", and minor seventh "M7" are respectively represented by numeric data "0", "1", "2" and "3." "DIATONIC" and "DORIAN" scales are respectively represented by numeric data "0" and "1." Twelve pitch classes for chord root and keynote are represented by C="0", C♯="1", and so on and B="11". Note types or functions of "CHORD TONE (CT)", "AVAILABLE NOTE (AN)", "SCALE NOTE (SN)", "TENSION NOTE (TN)" and "AVOID NOTE (AV)" are respectively represented by numeric data "0", "1", "2", "3" and "4." A location for chord root is defined by "0", whereas a location for chord type is specified by "1."

FIG. 4 shows a standard pitch class set storage. The standard pitch class set storage resides in ROM 4 shown in FIG. 2 and is used to identify note type or function of a pitch candidate, as will be described. The standard pitch class storage comprises a chord tone memory ctDB[], a tension note memory tnDB[], and a scale note memory snDB[]. The chord tone memory ctDB[] stores chord members for respective chord types. The tension note memory tnDB[] stores tension notes for respective chord types. The scale note memory snDB[] stores scale notes for respective scales. Each pitch class set data word is configured by twelve bits in which bit 0 corresponds to "C", bit 1 corresponds to "C♯" and so on and bit position 11 corresponds to "B." A bit having a value of "1" means that the pitch class of that bit position is an element of the pitch class set whereas a bit having a value of "0" means that the pitch class .assigned to that bit position is not an element of the pitch class set. For instance, ctDB[MAJ], which is a chord tone pitch class set data word for chord type of major is represented by:

000010010001.

This means that pitch classes "C", "E" and "G" constitute a chord tone pitch class set of chord type "MAJ."

The chord tone memory ctDB[] and tension note memory tnDB[] are each looked up by a chord type contained in the entered musical background information and returns a chord tone pitch class set and a tension note pitch class set of that chord type, respectively. The scale note memory snDB[] is looked up by a note scale (scale type) specified in the entered musical background information and returns a pitch class set of that scale. The chord tone memory ctDB[] and tension note memory tnDB[] illustrated in FIG. 4 further store special pitch class set data ctDB[NC], tnDB[NC] for non-chord(type=NC). The variable "chord type" is set equal to "NC" or non-chord when no chord type is specified or defined by the entered musical background information. Similarly the scale note memory snDB[] stores a special pitch class set data word snDB[NS] for non-scale or "NS." The valuable "scale" is set to "NS" or non-scale when no scale is specified or defined by the entered musical background information.

FIG. 5 illustrates a melody material data memory pDB[]. The melody material data memory stores original melody data which is represented by a sequence of note data records. Each note data record (data per note), designated by 101, includes five data items, specifically, note-on time, duration, velocity, pitch and note type. An example of melody material data is shown, designated by 102.

Figure 6:
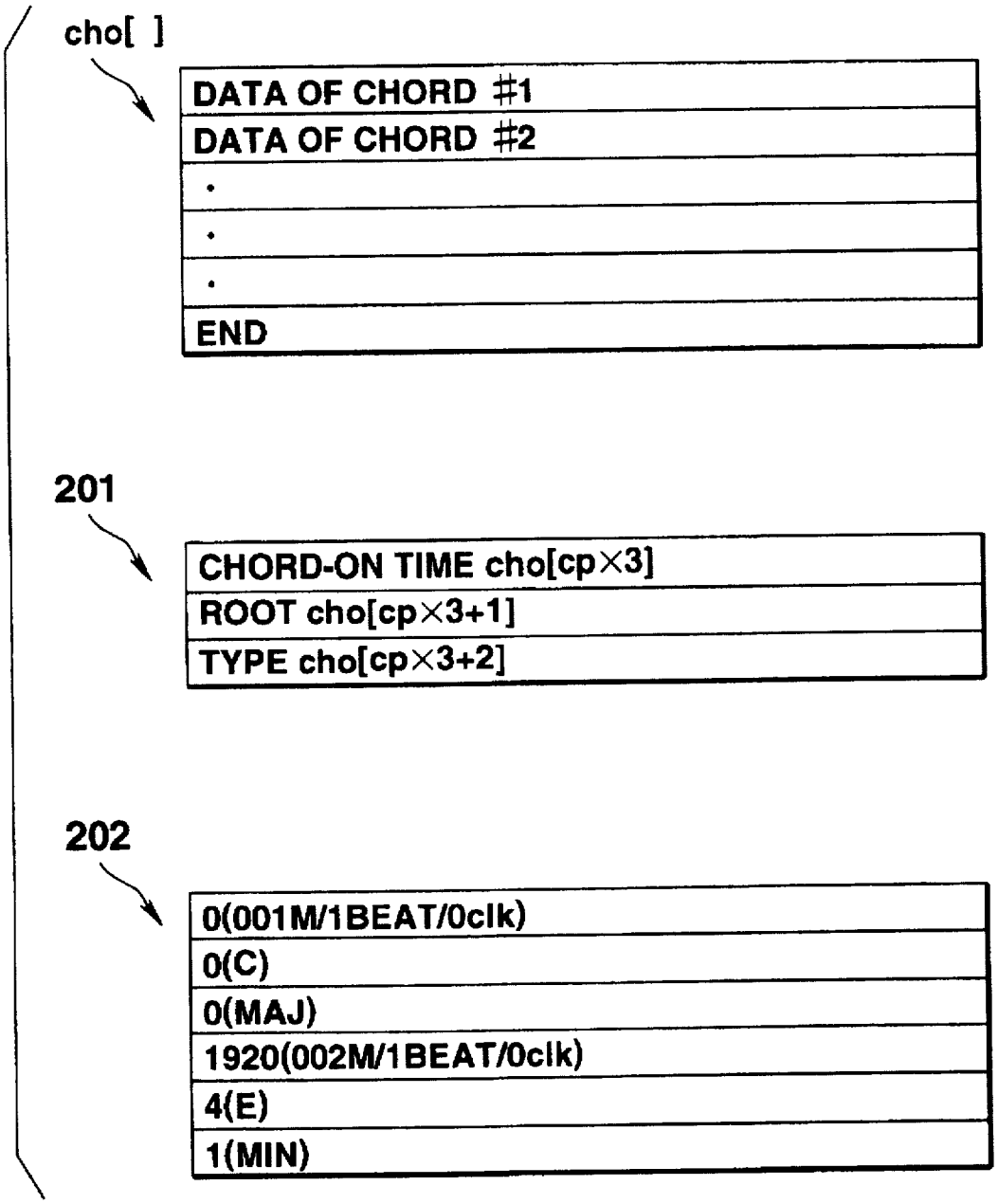
FIG. 6 shows a chord progression storage.

FIG. 6 illustrates chord progression memory cho[]. Chord progression memory cho[] stores data of a chord progression or succession entered. The chord progression data comprises a succession of chord data records. Each chord data record, designated by 201, contains three data items, specifically, chord-on time, root and type. An example of chord progression data is designated by 202.

Figure 7:
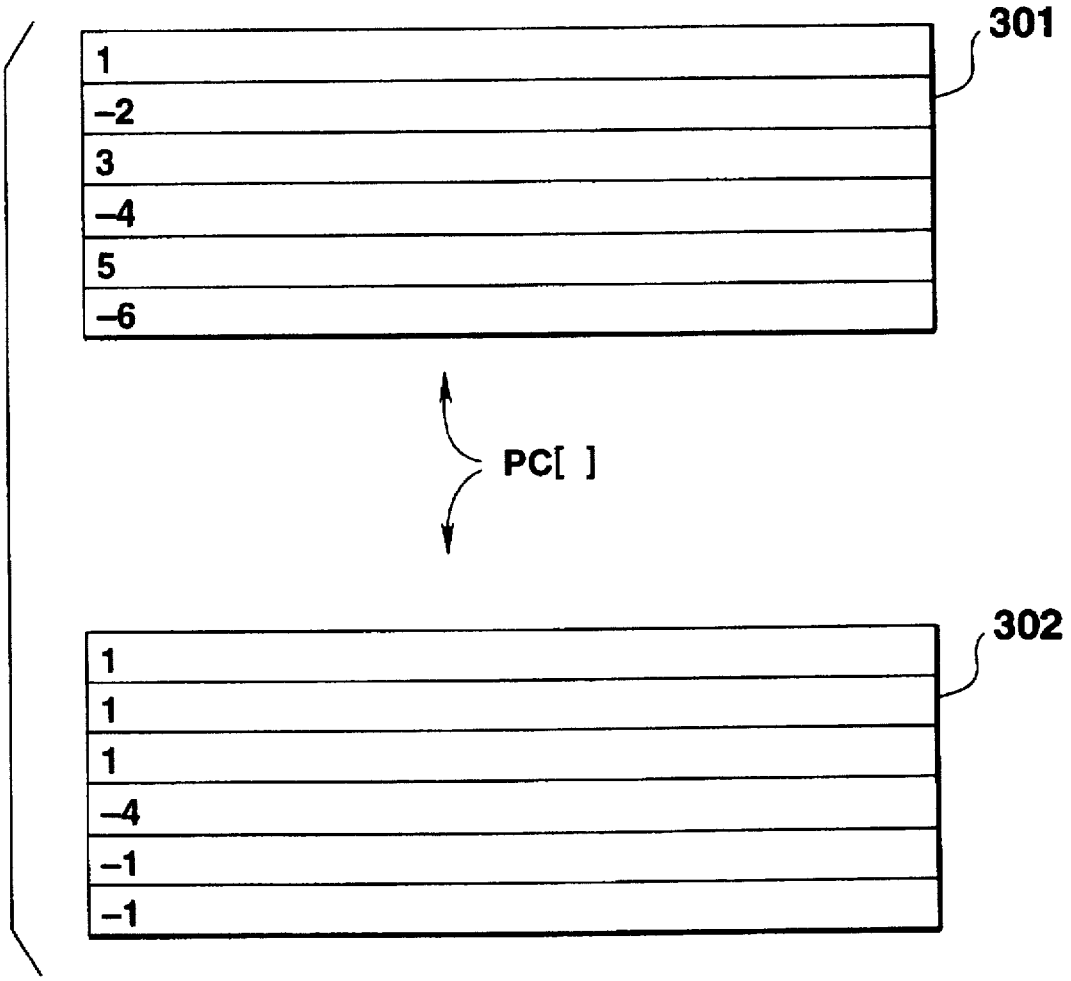
FIG. 7 shows a pitch difference table storage.

FIG. 7 illustrates a pitch difference memory pc[]. The pitch difference memory pc[] stores a succession of pitch differences which are successively used to generate a plurality of pitch candidates. In FIG. 7, a pitch difference memory 301 stores a succession of pitch differences "1", "−2", "3", "−4", "5" and "−6." Using the pitch difference memory 301 and an initial pitch candidate INT, a pitch candidate generator successively generates pitch candidates having pitches INT, semitone above INT, semitone below INT, two semitones above INT, two semitones below INT, three semitones above INT, three semitones below INT in this order. Using another pitch difference memory 302 which stores a pitch difference succession "1", "1", "1", "−4", "−1" and "−1", the pitch candidate generator successively generates pitch candidates of pitches INT, semitone above INT, two semitones above INT, three semitones above INT, one semitone below INT, two semitones below INT and three semitones below INT in this order.

FIG. 8 shows a variable list used in the embodiment. A variable "key" indicates a pitch class of an entered keynote or tonic with which a note scale starts. A variable "scale" indicates a type of the entered note scale. A variable "nt" indicates a note type or function of a pitch candidate or an original pitch. A variable "pitch" indicates a pitch of a pitch candidate. A variable "pccnt" is a pitch candidate counter. Variables "cp", "top" and "pp" are pointers to chord progression data, composed melody data, and melody material or original melody data, respectively. A variable or array me[] indicates composed melody data in which each note record contains four data items of note-on time, duration, velocity (sound intensity) and pitch. A variable chord[] represents a prevailing chord and contains two data items of chord[0], indicative of a chord root, and chord[1], indicative of a chord type. A flag cflag indicates whether a chord has been determined whereas a flag sflag indicates whether a note scale has been determined.

Figure 9:
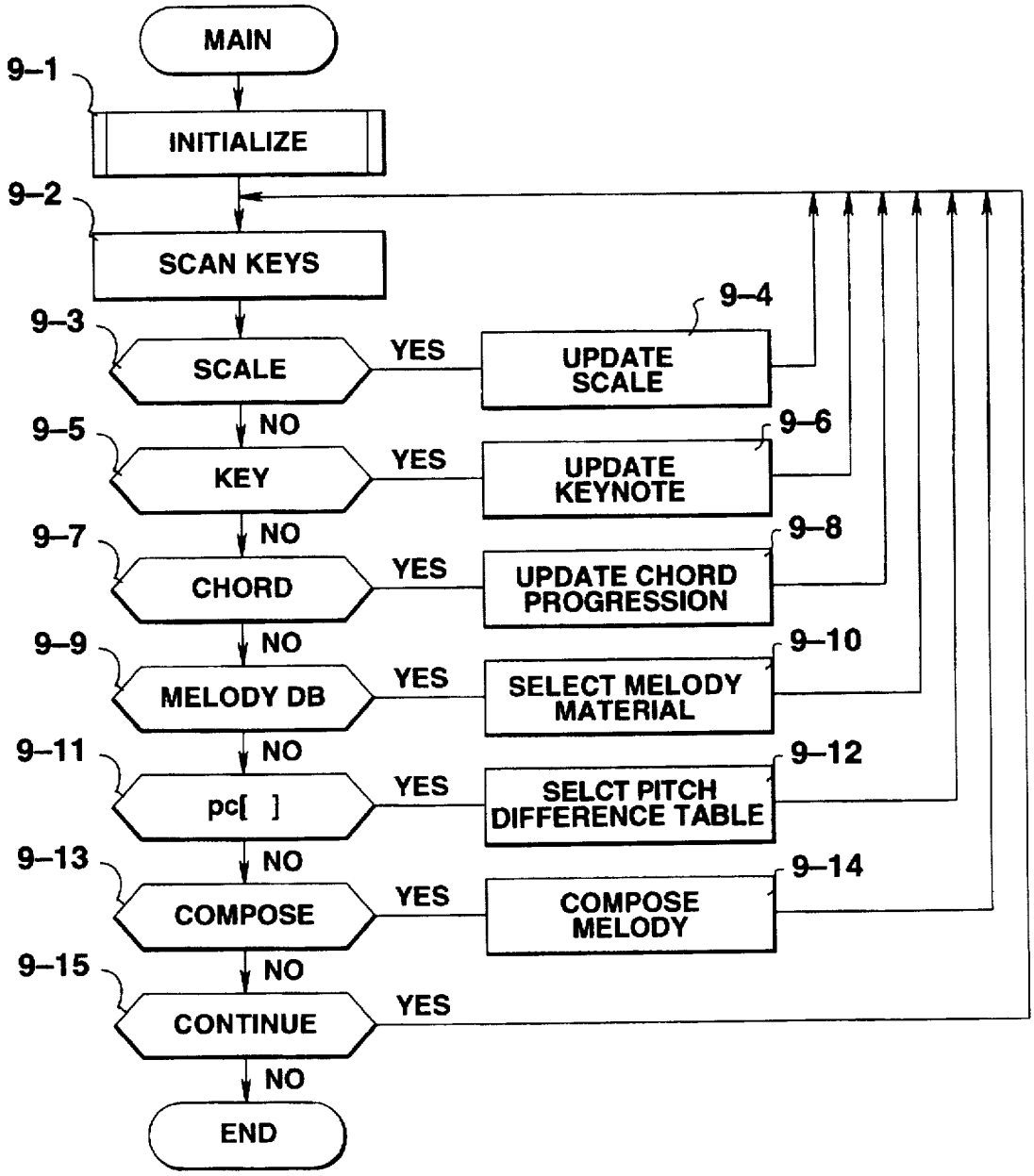
FIG. 9 is a flow chart of a main routine, showing an overall operation of the embodiment in accordance with the invention.

FIG. 9 is a flow chart of a main routine executed by CPU 1, showing an overall operation of the present machine composer. At step 9-1, CPU 1 initializes various variables (e.g., cflag=0, sflag=0). At step 9-2, CPU 1 reads panel switch 6 and keyboard 7 by scanning all keys thereof. In the following, CPU 1 executes a process required by an input command from the panel switch 6 or keyboard 7. If the input command is an update scale command "SCALE" (9-3), CPU 1 updates the variable "scale" (9-4). In response to an update keynote command "KEY" (9-5), CPU 1 updates the variable "key" (9-6). For an update chord progression command "CHORD" (9-7), CPU 1 updates the chord progression memory variable cho[] shown in FIG. 6 (9-8). In response to a select melody material command "MELODYDB" (9-9), CPU 1 selects from melody materials stored in ROM 4 and RAM 5, a desired melody material (9-10), as pDB[]. For an input command of select pitch difference table "pc[]" (9-11), CPU 1 selects, from a plurality of pitch difference tables (e.g., 301, 302 etc.,) in ROM 4, an appropriate pitch difference table, as pc[] (9-12). In response to a compose command "COMPOSE" (9-13), CPU 1 composes a melody (9-14). In response to a terminating command (Continue=No at step 9-15), the main routine terminates.

Figure 10:
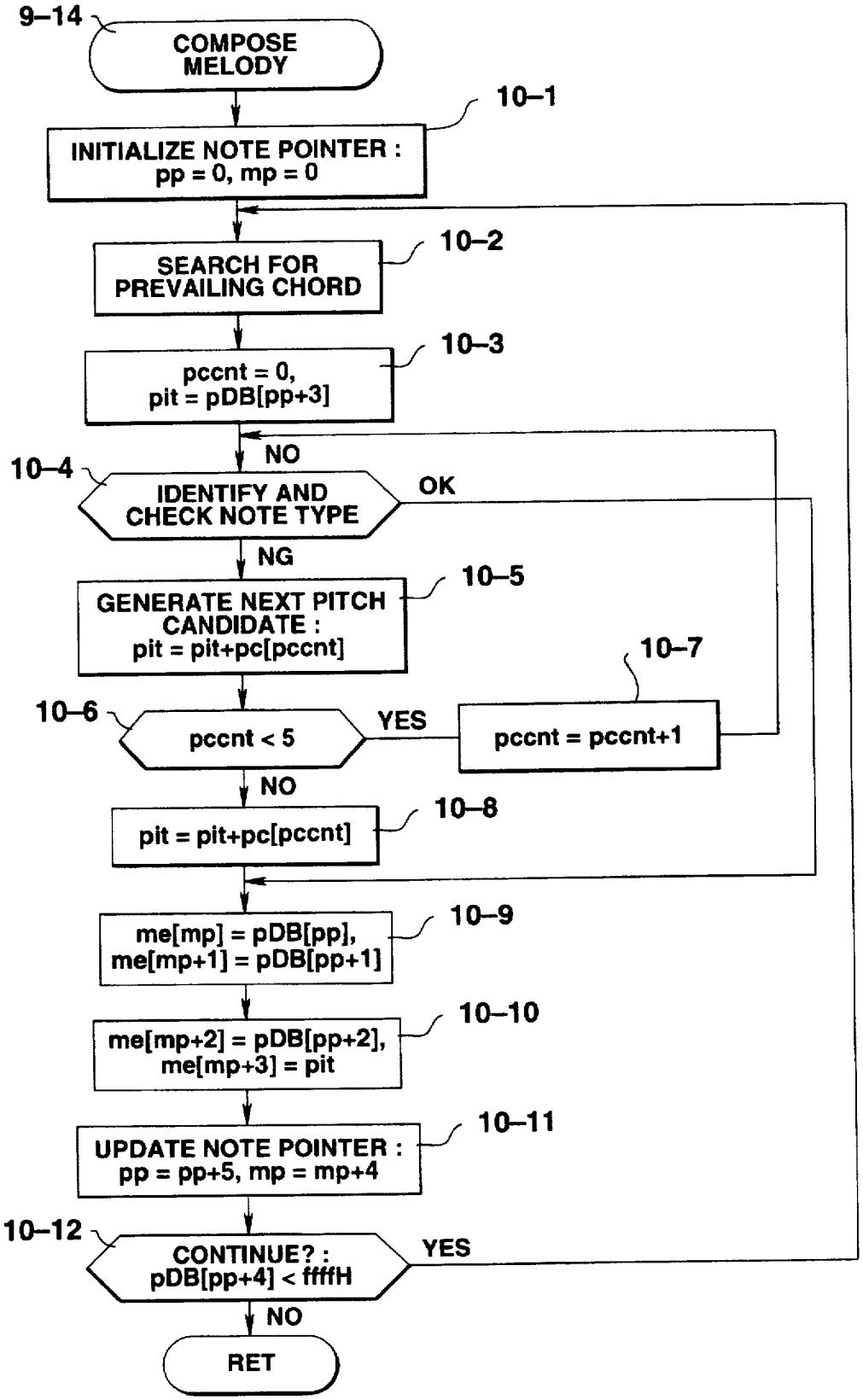
FIG. 10 is a flow chart of a compose melody routine in accordance with the invention.

FIG. 10 is a flow chart of the compose melody routine 9-14 in accordance with the invention. A first step 10-1 initializes note pointers me[pp] (for melody material memory pDB[]) and mp (for composed melody memory) as pp=0 and top=0.

The next step 10-2 of search for a prevailing chord is done as follows. If a chord has not been determined (cflag=0), the prevailing chord root chord[0] is set equal to "0", and prevailing chord type chord[1] is set equal to "NC" or no chord. If a chord or chord progression has been determined (cflag=1), the chord progression memory cho[] is searched or explored therethrough to find a chord which is prevailing or existent at a note-on time of a note of interest. To this end, compare the note-on time data pDB[pp] with successive chord-on time data cho[cp*3] while incrementing chord pointer cp. Find cp that satisfies:

either, cho[cp*3]<pDB[pp] and cho[(cp+1)*3]>pDB[pp], or cho[cp*3]=pDB[pp].

Then the contents (chord root and type) of the chord addressed by the chord pointer cp, just found, is set to a prevailing chord variable chord[] by:

chord[0]=cho[cp*3+1], and chord[1] =cho[cp*3+2].

In this manner, variables chord[0] and chord[1] respectively represent root and type of a chord coincident with a melody note of interest.

Next, an initialize pitch candidate step 10-3 is executed to initialize the first pitch candidate of composed melody note equal to the original melody note pitch from the melody material memory as:

pit=pDB[pp+3], and initialize the pitch candidate counter pccnt as:

pccnt=0.

The step 10-4 of an identify and check note type routine identifies a note type of a pitch candidate according to the entered musical background information and compares the identified note type of a pitch candidate pit with the note type pDB[pp+4] of the original melody note pitch pDB[pp+3]. If the pitch candidate note type specified in the context of the entered musical background has a predetermined relationship with the original melody note type, that pitch candidate is accepted as an adapted pitch so that the compose melody routine goes to a step 10-9. In the negative, the the composed melody routine executes a step 10-5 to generate a next pitch candidate. The next or new pitch candidate is generated by adding a pitch difference from the pitch difference memory to the old pitch candidate pit as:

pit=pit+pc[pccnt].

Then pitch candidate counter pccnt is incremented (10-7). The compose melody routine returns to the step 10-4 to identify and check the note type with respect the next pitch candidate. If the step 10-4 has successively yielded NG or negative for a predetermined number of (here seven) pitch candidates the step 10-6 will see pccnt=5. Thus the compose melody routine executes a step 10-8 to set pit equal to the original pitch pDB[pp+3] of the original melody note before executing the step 10-9.

The steps 10-9 and 10-10 copy note-on time pDB[], duration pDB[pp+1] and velocity pDB[pp+2] of an original melody note from the melody material memory into note-on time me[mp], duration me[mp+1] and velocity me[top+2] of a composed melody note, respectively, and use data pit of an adapted pitch as accepted by the step 10-4 or the original melody note pitch data pit set by step 10-8 for pitch data me[top+3] of the composed melody note.

Next step 10-11 updates note pointers pp and mp to process a next note as:

pp=pp+5, and mp=mp+4.

A step 10-12 checks whether all notes have been processed or composed (pDB[pp+4]=ffffH or "terminal"). In the negative the compose melody routine repeats the process from the step 10-2.

Figure 11:
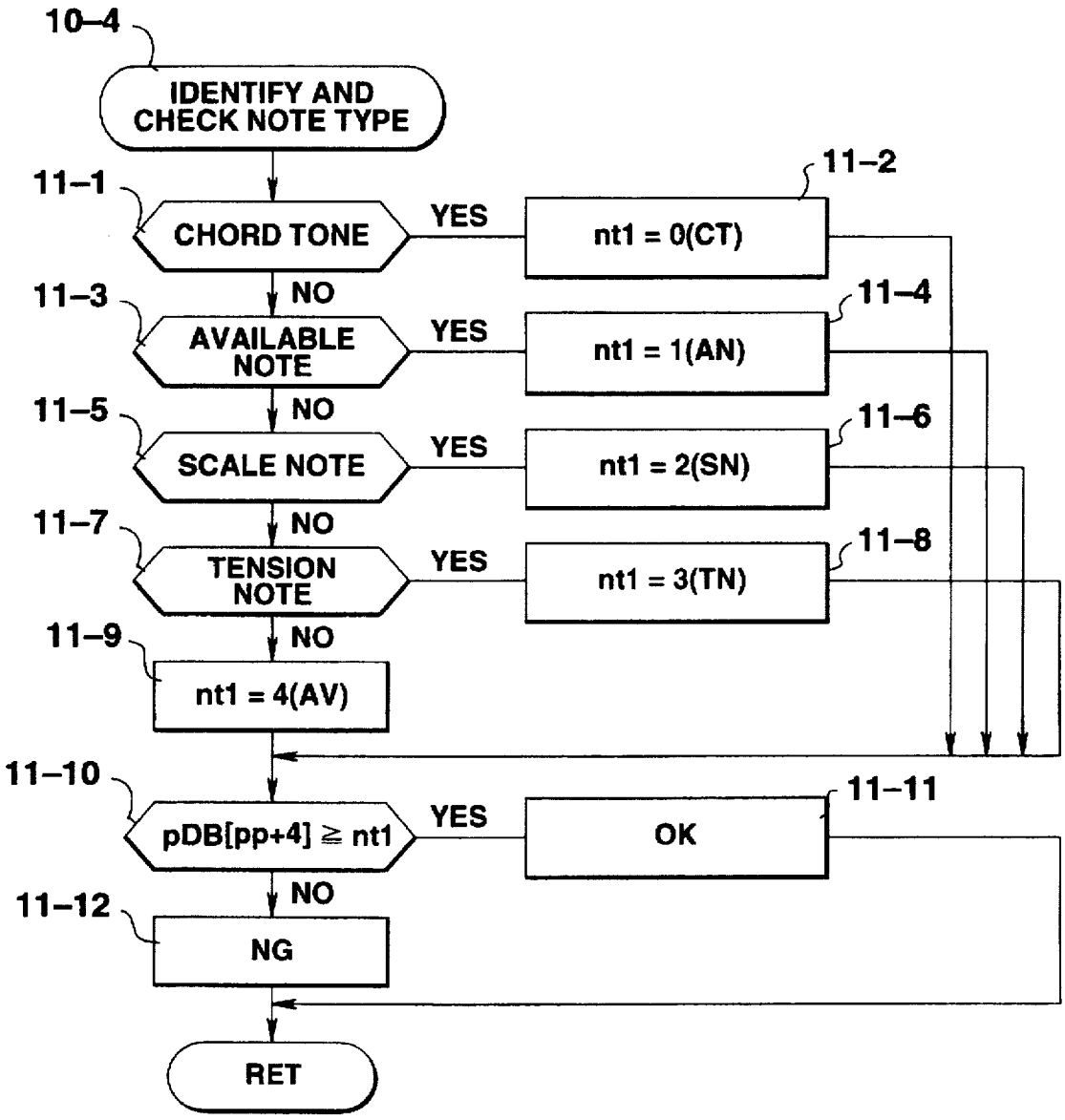
FIG. 11 is a flow chart of an identify and check note type routine.

FIG. 11 is a flow chart of the identify and check note type routine 10-4. Steps 11-1 to 11-9 in this routine 10-4 identify a note type or function nt1 of a pitch candidate pit according to entered musical background information.

More specifically, the step 11-1 checks whether the pitch candidate pit is a chord tone or not. To this end, from the chord tone memory ctDB[], a chord tone pitch class set ctDB[chord[TYPE]] of a chord type of prevailing musical background is retrieved and set into a variable pcs by:

pcs=ctD B[chord[TYPE] ].

Using a pitch candidate pit, a pitch name or pitch class pc of the pitch candidate pit relative to a prevailing chord root is determined by:

pc=(pit-cho[ROOT]+12)mod12.

A check is made as to whether the pc is an element of pcs. The pc is an element of the chord tone pitch class set pcs on the condition:

$2^{pc} \cap pcs = 2^{pc}$, in which $2^{pc}$=twelve-bit binary "pitch class" word having a bit of "1" at pc-th bit position, $\cap$=bit-by-bit AND operation, and pcs=twelve-bit binary "pitch class set" word having bits of "1" at respective pcs element bit positions.

In the affirmative, the pitch candidate pit is considered chord tone. Then the note type nt1 is set to equal to "0(CT)" at step 11-2.

The step 11-3 tests the pitch candidate pit to see whether it is an available note. To this end, from the tension note memory tnDB[] in FIG. 4, a tension note pitch class set of a prevailing chord type chord[TYPE] is retrieved and set into pcs1 by:

pcs1=tnDB[chord[TYPE]].

From the scale note memory snDB[], a scale note pitch class set of the musical background scale is retrieved and set into pcs2 by:

pcs2=snDB[scale].

Further, a pitch class or interval pc1 of the pitch candidate from the prevailing chord root chord[ROOT] is determined by:

pc1=(pit-chord[ROOT]+12)mod12.

A pitch class or interval pc2 of the pitch candidate from the keynote or tonic "key" is determined by:

pc2=(pit-key*12)mod12.

If $2^{pc1} \cap$pc1 matches $2^{pc1}$ and if $2^{pc2} \cap$pcs2 matches $2^{pc2}$, then the pitch candidate pit is considered available note since it is an element of tension note pitch class set and at the same time an element of scale note pitch class set. Then step 11-4 sets the note type variable nt1 equal to "1 (AN)."

Step 11-5 tests the pitch candidate pit to see whether it is a scale note. To this end, a scale note pitch class set snDB[SCALE] of the musical background scale is retrieved and set into pcs. A pitch interval pc of the pitch candidate pit from the keynote "key" (i.e., pitch class of the pitch candidate obtained when it is transposed to keynote "C") is determined by:

pc=(pit-key+12)mod12.

If $2^{pc} \cap$pcs1 matches $2^{pc}$, the pitch candidate pit is considered scale note so that the step 11-6 sets the note type variable nt1 to "2" indicative of scale note (SN).

The step 11-7 checks whether the pitch candidate pit is a tension note. To this end, a tension note pitch class set tnDB[TYPE] of the prevailing musical background chord type chord[TYPE] is retrieved from the tension note memory and set into pcs. A pitch interval pc of the pitch candidate pit from the prevailing chord[ROOT], that is the pitch class of pit obtained when it is transposed to the chord root of C is determined by:

pc=(pit-chord[ROOT]+12)mod12.

If $2^{pc} \cap$pcs matches $2^{pc}$, the pitch candidate pit is considered tension note so that the step 11-8 sets the note type variable nt1 of the pitch candidate to "3" indicative of tension note (TN).

If the pitch candidate pit is not chord tone (11-1), available note (11-3), scale note (11-5) or tension note (11-7), the pitch candidate pit is considered avoid note so that the step 11-9 sets the note type variable nt1 of the pitch candidate to "4" indicative of avoid note or AV.

In this manner these steps 11-1 to 11-9 constitute an identify note type subroutine.

After identifying the note type of a pitch candidate (11-1 to 11-9), the step 11-10 compares the note type nt1 of the pitch candidate pit with a stored note type pDB[pp+4] of an original note from the melody material memory. If pDB[pp+4]≧=nt1 holds, the pitch candidate pitch is considered adapted or OK at step 11-11. In the negative, the pitch candidate pit is considered unadapted or NG at step 11-12. As described with respect to FIG. 3, note type numerical data "0" is assigned to note type "chord tone", numerical data "1" to note type "available note", numerical data "2" to note type "scale note", numerical data "3" to note type "tension note" and numerical data "4" to note type "avoid note". Each numerical representation of note type may also be regarded as representative of priority of the note type. The smaller the number, the higher the priority. The note type criterion of pDB[pp+4]≧nt1 employed in 11-9 means that the note type of the pitch candidate pit has priority not less than that of the original note type.

Let us take up an operation example of the compose melody routine shown in FIG. 10. The note type test block 10-4 references the standard pitch class set memory shown in FIG. 4 according to a flow charted routine of FIG. 11. The memory 301 shown in FIG. 7 is used for the pitch difference memory pc[].

The melody material data shown in FIG. 12 is used for original melody pDB[].

A first data entry condition of music background information is as follows:

key=G, scale=diatonic (scale notes of G, A, B, C, D, E and F♯), and chord=CM7 (chord tone pcs of C, E, G and B, and tension note pcs of D, F♯ and A).

The operation results are shown in FIG. 13. The results show that the original pitch succession C4, D4, E4, F4 and G4 of the melody material shown in FIG. 12 has been changed to a pitch succession C4, D4, E4, F♯4 and G4.

A second data entry condition of musical background information is as follows:

key=A, scale=diatonic (scale note A, B, C♯, C, D, E, F♯ and G♯), and chord=EMAJ (chord tone pcs of E, G♯ and B, and tension note pcs of F♯, B♭ and C♯).

With such musical background information, the operation results are shown in FIG. 14. In this case the original pitch succession C4, D4, E4, F4 and G4 of the melody material has been changed to a pitch succession B3, C♯4, E4, F♯4 and A b 4.

FIG. 15 illustrates another melody material which includes a pitch succession of C4, D4, F4, F♯4 and G♯4. Let us take up a data entry condition of chord only without keynote or scale. Let an entered chord be EMAJ (chord tone pcs of E, G♯ and B, and tension note pcs of F♯, B♭ and C♯). With this chord, the operation results are shown in FIG. 16. In this case, the original pitch succession C4, D4, F4, F♯ 4 and G♯ 4 of the melody material has been changed to a pitch succession of B3, C♯4, F4, F♯4 and G♯4. The compose melody routine of FIG. 10, which executes the identify and check note type step 10-4 according to a flow chart of FIG. 11, can not only respond to complete musical background information having keynote, note scale and chord progression but also respond to incomplete or partial musical background information having a chord progression only and can compose a melody adapted to either complete or incomplete musical background.

Figure 17:
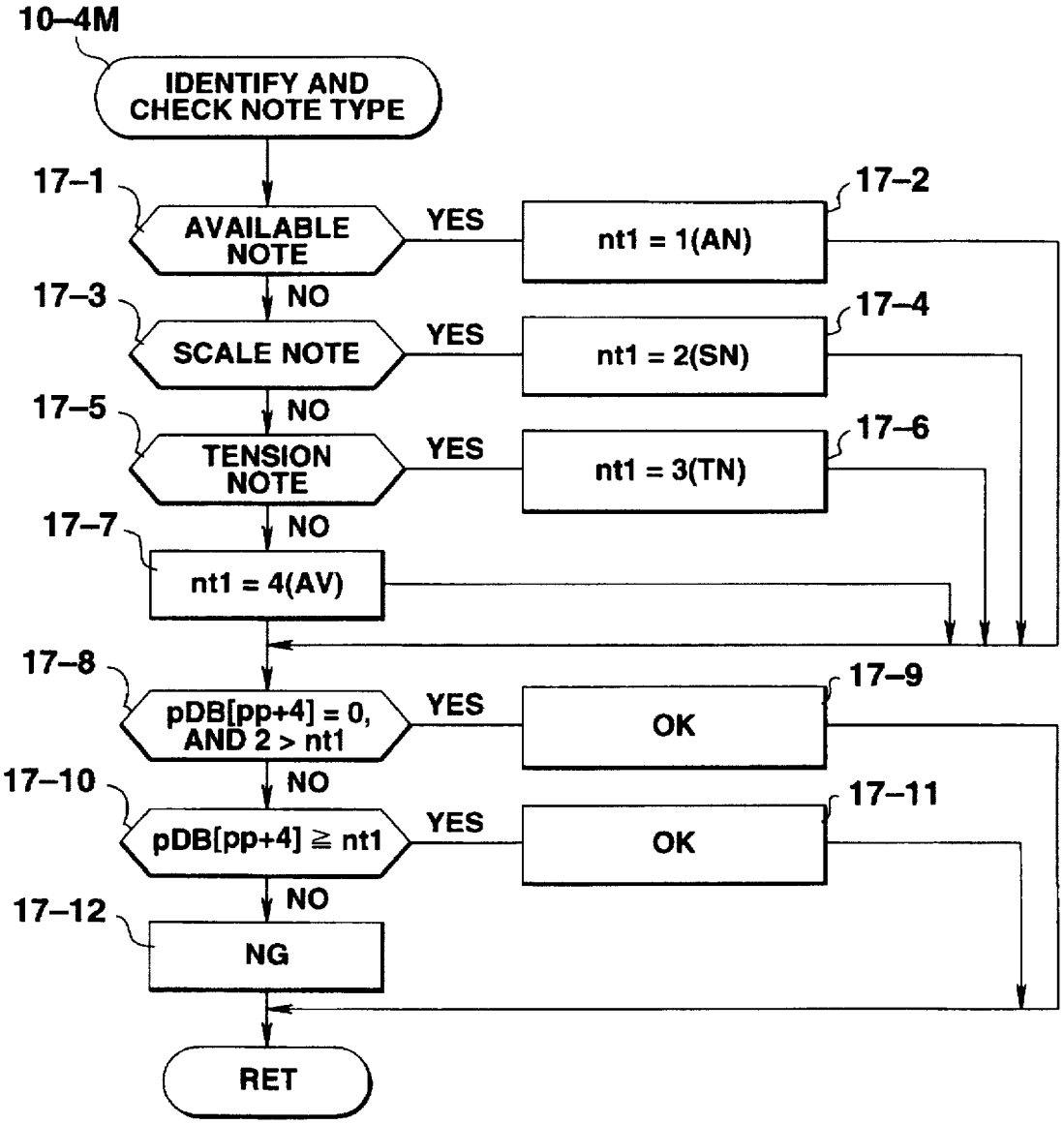
FIG. 17 is a flow chart of a modified routine of identify and check note type.

FIG. 17 is a flow chart of a modification of the identify and check note type routine, designated by 10-4M. The illustrated routine of FIG. 17 includes an identify note type subroutine (17-1 to 17-7) differing from that (11-1 to 11-9) in the identify and check note type routine of FIG. 11. Specifically the routine of FIG. 17 does not include a chord tone test step, such as the one 11-1 in FIG. 11, and checks a pitch candidate as to whether it pertains to an available note (17-1), whether it pertains to a scale note (17-3), or whether it pertains to a tension note (17-5). Thus the note type nt1 of the pitch candidate pit is labelled with an available note "1" (17-2), scale note "2" (17-4), tension note "3" (17-6) or avoid note "4" (17-7). A pitch candidate is labelled with OK, meaning that the pitch candidate is found adapted to the entered musical background, at step 17-9 if a note type condition specified in the block 17-8 is met. The condition is given by:

pDB[pp+4]=0 and 2>nt1.

This condition reads that if an original note type from the melody material is a chord tone, a pitch candidate must have a note type or function of available note to adapt to the musical background. The other steps 17-10, 17-11 and 17-12 are identical with steps 11-10, 11-11 and 11-12 in FIG. 11.

A description is now made to an operation of the compose melody routine of FIG. 10 in which the identify and check note type process 10-4 is performed according to a modified routine 10-4M of FIG. 17. As in the previous case, a pitch difference memory 301 of FIG. 7 and standard pitch class memory of FIG. 4 are used in the operation. Since the identify and check note type routine of FIG. 17 can handle incomplete musical background information without any chord or chord progression, the compose melody routine of FIG. 10, which executes the subroutine of FIG. 17 for note type identification and checking, can compose a melody adapted to such incomplete musical background information.

FIG. 18 illustrates a melody material example which has a pitch succession of C4, D4, F4, F♯4 and G♯4.

FIG. 19 shows operation results obtained with musical background information input of:

key=A, scale=diatonic (scale note pcs of A, B, C♯, D, E, F♯ and G♯), and chord=none (NC).

In this case the original pitch succession C4, D4, F4, F♯4 and G♯4 of the melody material has been changed to a pitch succession of C♯4, D4, F♯4, F♯4 and G♯4.

Figure 20:
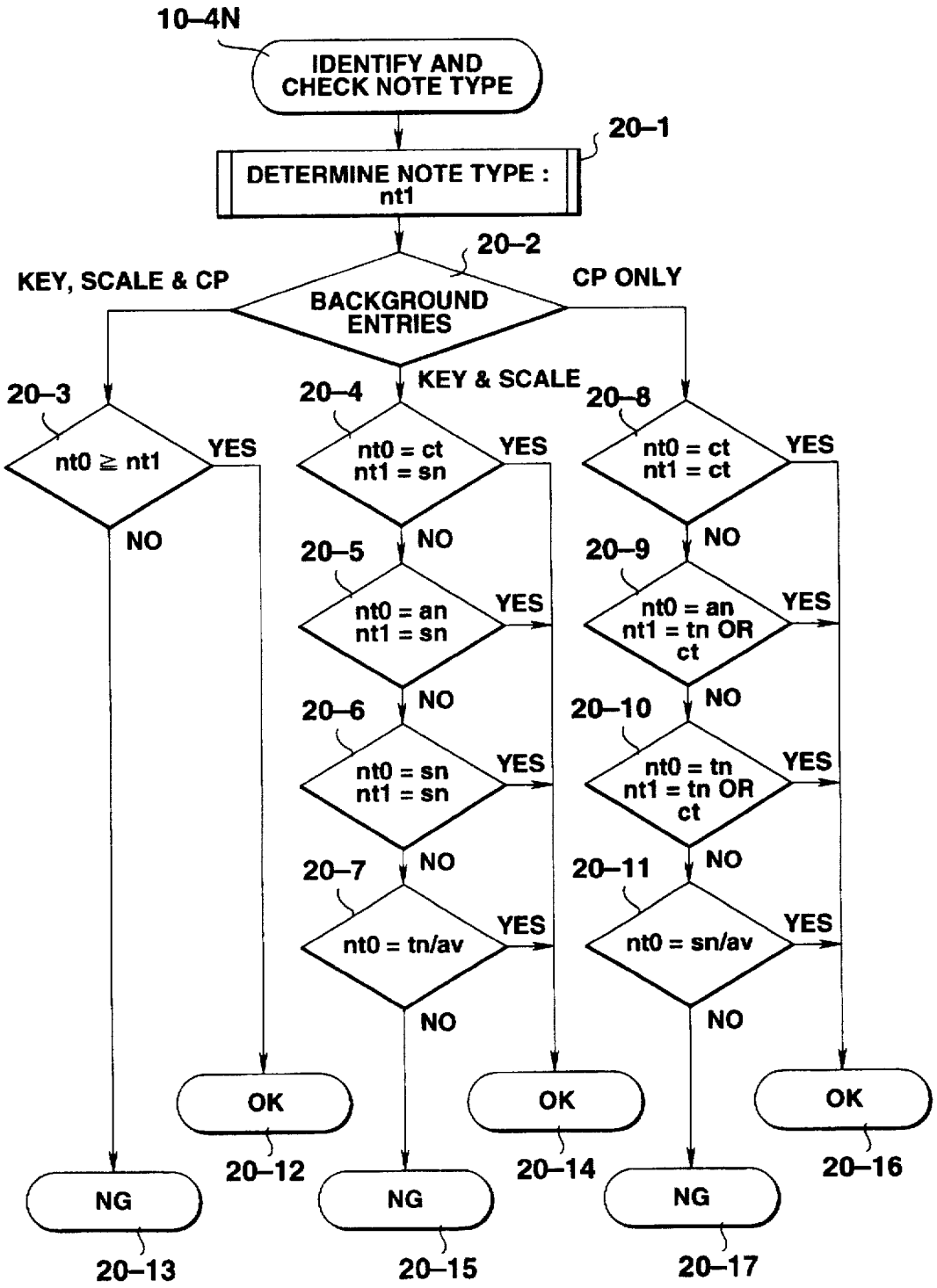
FIG. 20 is a flow chart of a further modified routine of identify and check note type.

FIG. 20 shows a further modification of the identify and check note type routine, designated by 10-4N. In FIG. 20, an identify note type block 20-1 is identical with steps 11-1 to 11-9 shown in FIG. 11. The block 20-1, however, employs a standard pitch class set memory shown in FIG. 21. The standard pitch class set memory of FIG. 21 differs from the standard pitch class set memory of FIG. 4 in that the chord tone memory ctDB[] and tension note memory tnDB [], each does not include a special pitch class set data record for no chord input or NC and that the scale note memory snDB[] does not include a special pitch class set data record for no scale input or NS.

The step 20-2 checks data entries of musical background information. The musical background information is given by one of the three ways:

(a) entering key note, scale and chord progression (cflag=1, sflag=1), (b) entering key note and scale (cflag=0, sflag=1), or (c) entering chord progression only (cflag=1, sflag=0).

In the case (a) when key note, scale and chord progression have been entered as musical background information, the routine goes to the step 20-3. If nt0>nt1, the pitch candidate is accepted as adapted (20-12). Otherwise it is rejected (20-13). Here, ut0 indicates an original note type from the melody material whereas ut1 indicates a note type of a pitch candidate, identified according to the entered musical background information. The condition nt0≧nt1 is identical with the condition pDB[pp+4]24 nt1 indicated in the step 11-10 shown in FIG. 11.

In the case (b) when only key note and scale have been entered as musical background information, the routine determines adaptability of pitch candidate pit as follows. Since no chord has been entered in the case (b), pitch candidate pit is labelled with note type nt1 of scale note (SN) or avoid note (AV). If the material (original) note type is chord tone CT, the pitch candidate note type nt1 must be scale note (SN) to adapt to the musical background (20-4, 20-14). Next, if the material note type is available note (AN), the pitch candidate note type nt1 must be scale note to adapt to the musical background (20-5, 20-14). Next, if the material note type is scale note (SN), the pitch candidate note type must be scale note (20-6, 20-14). If the material note type is tension note or avoid note (20-7), the pitch candidate is determined "adapted" whichever note type is (20-7, 20-14). If none of the above conditions is met, the pitch candidate is rejected as "not adapted" (20-15).

In the case (c) when a chord progression only has been entered as musical background information, the routine of FIG. 20 determines background adaptability of pitch candidate pit as follows. Since neither key note nor scale has been entered in the case (c), pitch candidate note type nt1 is classified into chord tone (CT), tension note (TN) or avoid note (AV). First, if the material note type nt0 is chord tone (CT), the candidate note type nt1 must be chord tone to adapt to the musical background (20-8, 20-16). If the material note type nt0 is available note (AN), the pitch candidate note type must be tension note (TN) or chord tone (CT) (20-10, 20-16). If the material note type is scale note (SN) or avoid note (AV), any pitch candidate is determined "adapted" whatever note type is (20-11, 20-16). If none of the above conditions is met, pitch candidate is determined "not adapted" (20-17).

Figure 22:
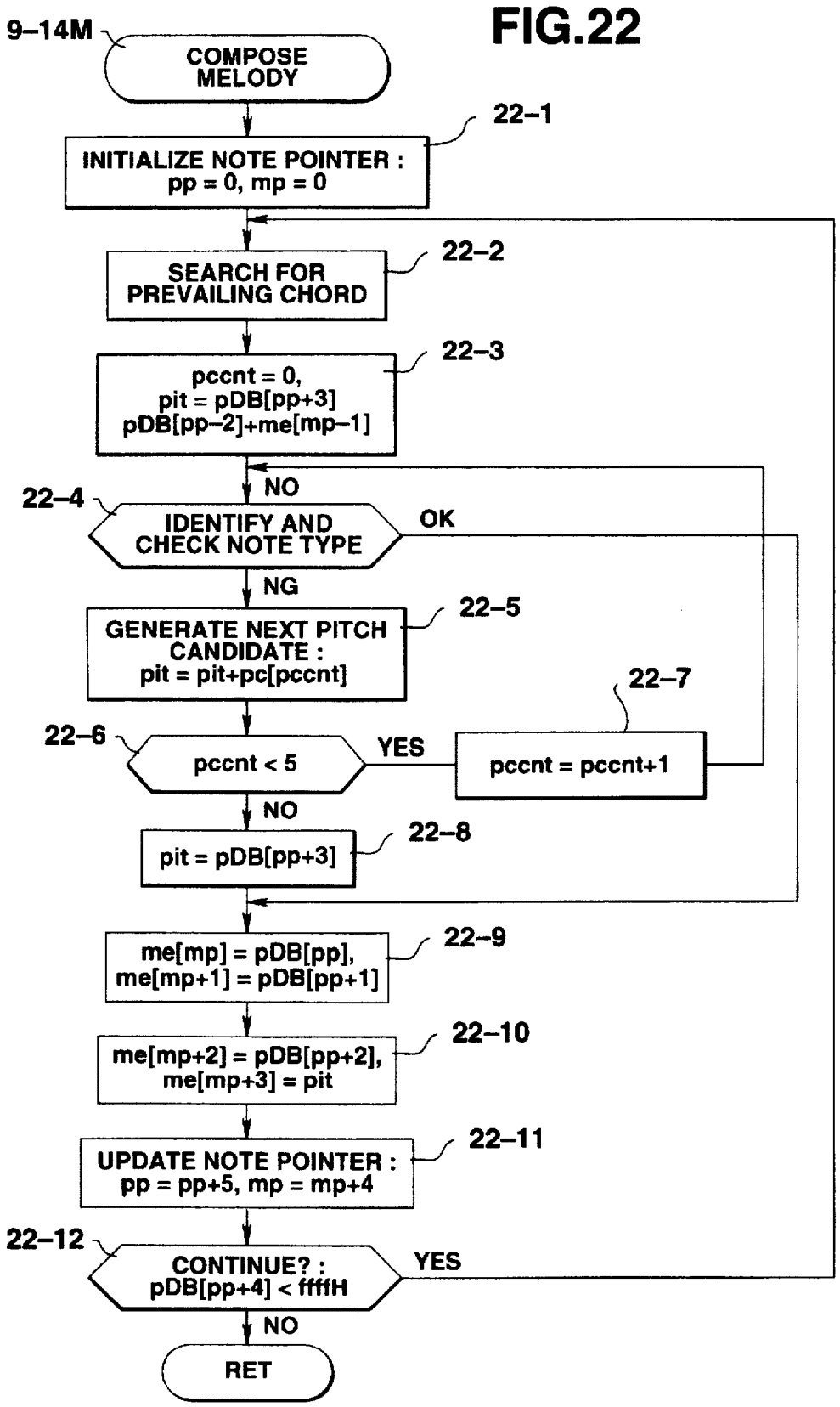
FIG. 22 is a flow chart of a modified routine of compose melody in accordance with the invention.

FIG. 22 shows a modification of the compose melody routine, designated by 9-14M. The modified routine 9-14M of FIG. 22 differs from the compose melody routine of FIG. 10 in determining the initial or first pitch candidate. According to the compose melody routine of FIG. 22, step 22-3 determines the initial pitch candidate pit by:

pit=pD B[pp+3]−pD B[pp−2]+me[mp−1], in which the term pDB[pp+3]−pDB[pp−2] indicates an original pitch interval from previous to current pitch from the melody material, me[mp−1] indicates a previous pitch that has been composed. Thus the initial pitch candidate pit is determined by a previous pitch of composed or adapted plus pitch interval of current original pitch from previous original pitch of the melody material. This intends to make a pitch interval formed between adjacent notes of a compose melody as close as possible to a pitch interval formed between original adjacent notes of the melody material. The remaining steps 22-1, 22-2 and 22-4 to 22-12 in FIG. 22 are identical with corresponding steps 10-1, 10-2 and 10-4 to 10-12 in FIG. 10.

An operation example of the compose melody routine of FIG. 22 is now described.

FIG. 23 illustrates a melody material example which was used in the operation. The first note of the illustrated melody material has a pitch of C4, and a note type of chord tone (CT). The second note has a pitch D4 and note type of available note (AN). Third note has a pitch F4 and a note type of scale note (SN). Fourth note has a pitch of F♯4 and a note type of tension note (TN). The fifth note has a pitch of G♯4 and a note type of avoid note (AV).

Musical background information that has been entered is as follows:

no chord input, key=A scale=diatonic (scale note pcs of A, B, C♯, D, E, F♯ and G♯).

FIG. 24 shows the operation results. As shown in FIG. 24, the first note of the melody material (C4, CT) has been changed to a pitch of C♯4 (and note type of scale note SN). The second note of the melody material, (D4, AN), has been changed to a pitch E4 (and a note type of scale note SN). The third note of the melody material, (F4, SN), has been changed to a pitch of G♯4 (and a note type of scale note SN). The fourth note of the melody material, (F♯4, TN), has been changed to a pitch of A4 (and a note type of scale note SN). The fifth note of the original melody material, (G♯4, AV), has been changed a pitch of B4 (and a note type of scale note SN). The material's pitch succession C4, D4, F4, F♯4 and G♯4 has a pitch difference succession of two semitones, three semitones, one semitone and two semitones (2, 3, 1, 2). The composed melody's pitch succession of C♯4, E4, G♯4, A4 and B4 has a pitch difference succession of three semitones, four semitones, one semitone and two semi ones (3, 4, 1, 2) which pitch difference succession is very similar to the original pitch difference succession of the material.

In a further modified embodiment, each melody material data entity in a melody material database memory includes musical background information which may be substituted with respect to those musical background data items or features which have not been entered or specified.

Figure 26:
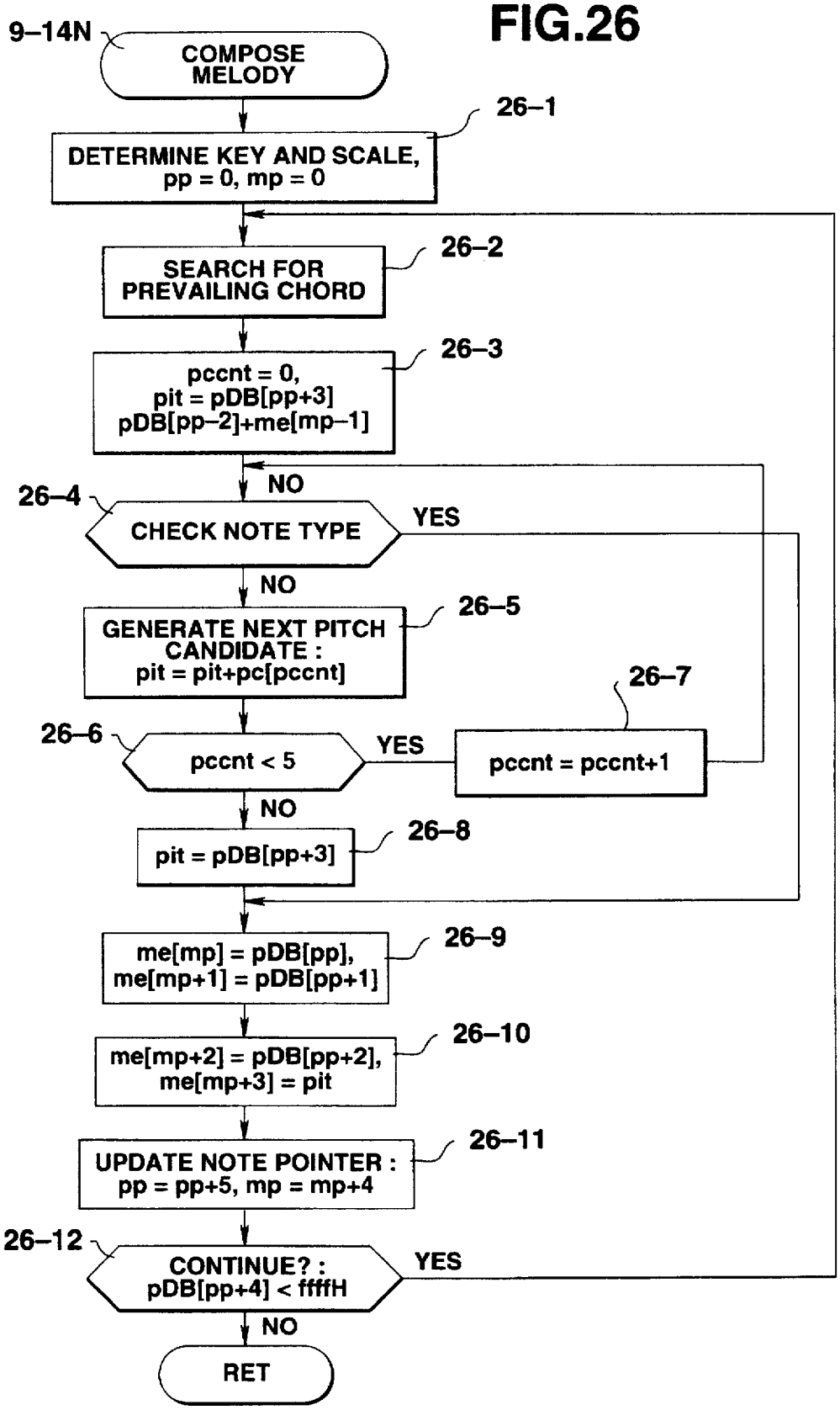
FIG. 26 is a flow chart of a compose melody routine using the melody material database in FIG. 25 in accordance with the invention.

Such a modification is shown in FIGS. 25 and 26. In FIG. 25, each melody material data entity contains keynote and scale information. Specifically, a material database header DB[] is provided. The material database header DB[] stores, for each melody material, keynote and scale information as well as address pointer to that material storage.

FIG. 26 is a flow chart of a compose melody routine 9-14N which uses the melody material database shown in FIG. 25. The first step 26-1 checks the scale sflag. If sflag=0, meaning neither keynote nor scale has been entered, as part of the musical background information, stored keynote and scale data of a selected melody material are retrieved and respectively set into variables "key" and "scale" to thereby determine keynote and scale. The remaining steps 26-2 to 26-12 of FIG. 26 are identical with corresponding steps 22-2 to 22-12 shown in FIG. 22, thus omitting further description.

This modification uses or substitutes stored keynote and scale data of a melody material in the case of no key or no scale input to thereby compose a natural melody.

In a further modified embodiment, a pitch candidate can be generated depending on direction of motion from one note to the next in the melody materials. An example is shown in FIG. 27.

Figure 27:
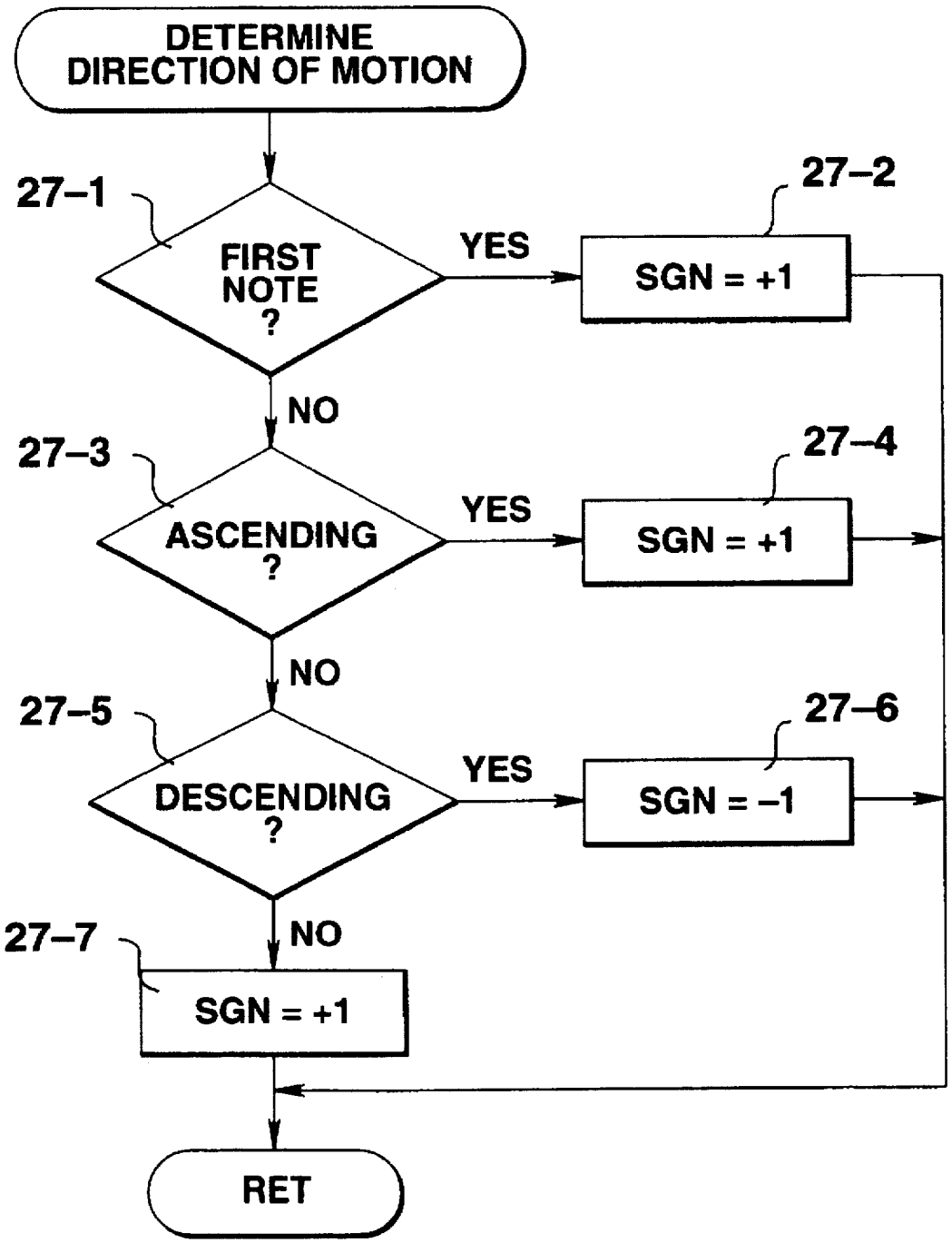
FIG. 27 is a flow chart of a determine direction of motion routine.

According to the flow chart of FIG. 27, if a current note of interest is a first note (27-1), a multiplier factor SGN for multiplying difference pitch data is set equal to "+1" (27-2). If the current note from a melody material has an ascending motion from the previous note in the melody material (pDB[pp+3]>pDB[pp−2]), the multiplier SGN is set to "+1" (27-3, 27-4). In the case of descending motion (pDB[pp+3]<pDB[pp−2]), the multiplier SGN is set equal to "−1" (27-5, 27-6). If the current and previous notes in the melody material have the same pitch or no motion therebetween, the multiplier SGN is set equal to "+1" (27-7). The multiplier SGN thus made is referenced by a pitch candidate generator corresponding to the block 10-5. If the multiplier SCN is "+1", the candidate generator generates a pitch candidate by:

pit=pit+pc[pccnt].

Thus a new pitch candidate is generated by adding a pitch difference pc[pccnt] to an old pitch candidate. If the multiplier SGN is "−1", the pitch candidate generator makes a new pitch candidate by subtracting a difference pitch pc[pccnt] from the old pitch candidate as:

pit=pit-pc[pccnt].

In a further modified embodiment, melody material data may be made from input data from user and then stored into RAM 5. An example is shown in FIG. 28.

Figure 28:
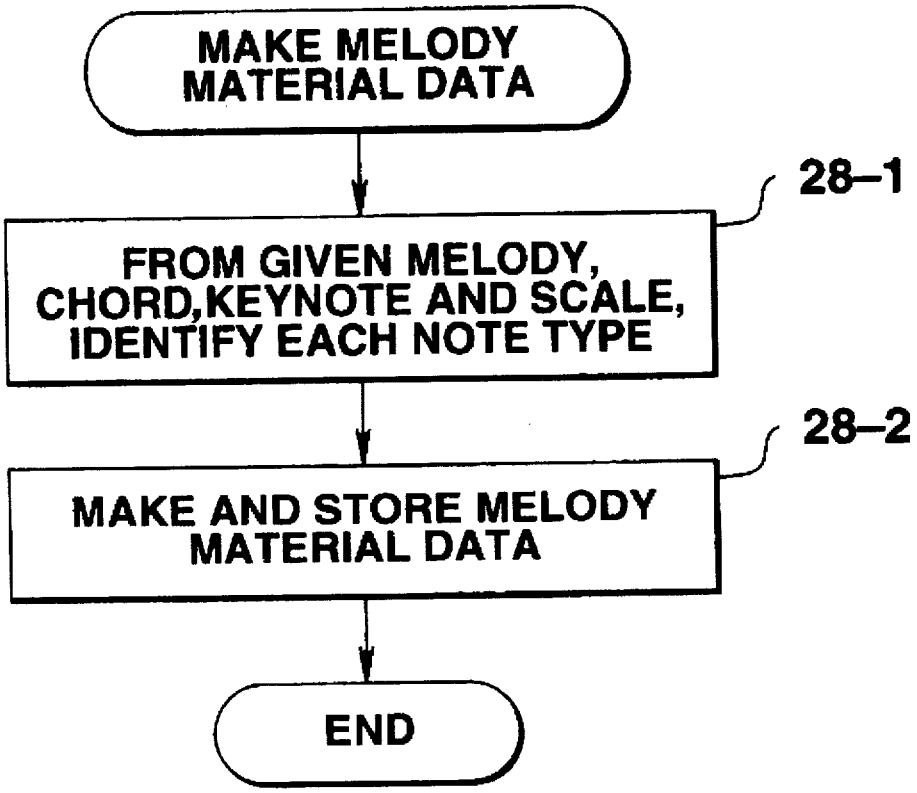
FIG. 28 is a flow chart of a make melody material data routine.

In the example of FIG. 28, a user supplies a melody (pitch and durational succession) and musical background features including chord (or chord progression), keynote and scale. The step 28-1 identifies note function of each supplied melody note based on the supplied musical background information. Step 28-2 makes melody material data according to a format shown in FIG. 5 and stores it into RAM 5.

A pitch adapter that employs a difference pitch succession table memory and standard pitch class memory, such as described in the illustrated embodiment, has an advantage of reduced storage capacity. If desired, however, a look up table may be used implement a pitch adapter.

Figure 29:
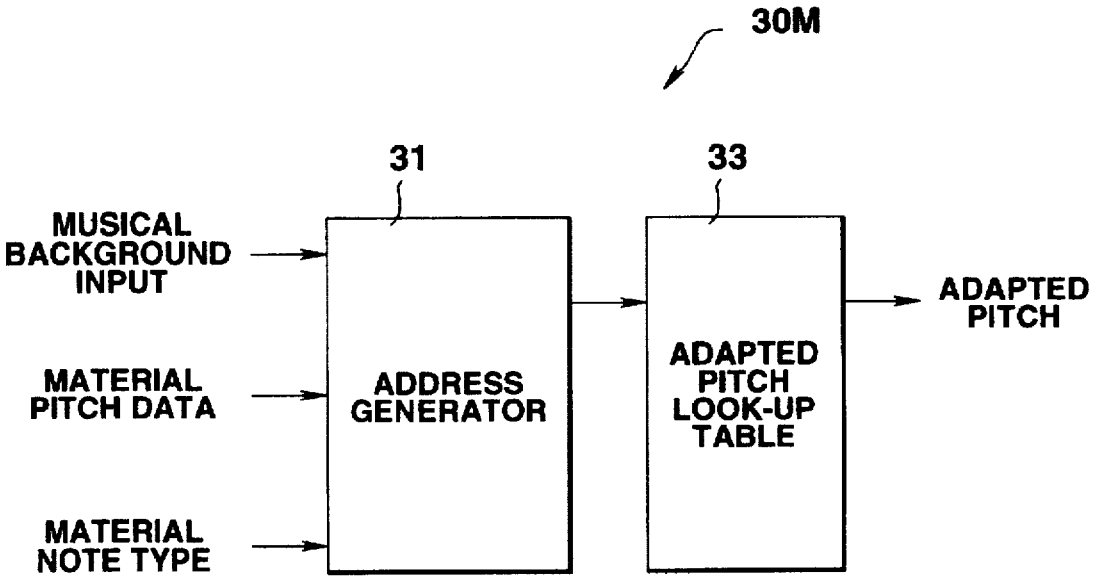
FIG. 29 is a function block diagram of a modified pitch adapter in accordance with the invention.

An example is shown in FIG. 29, as modified pitch generator 30M. An address generator 31 generates or computes an address from entered musical background information, pitch data in a melody material, and note type data in the melody material. The address from the address generator 31 is used to look up an adapted pitch look up table 33. The look up table 33 outputs an adapted pitch that is adapted to the entered background information and is a function of the original pitch from the melody material.

This concludes the detail description. However various modifications will be obvious to a person of ordinary skill in the art. Therefore, the scope of the invention should be defined solely by the appended claims.

What is claimed is:

1. A machine composer for music comprising:

music material storage means for storing data of a musical note succession represented by a plurality of note data records in which each note data record representative of a musical note in said musical note succession includes at least a pitch name and a note type indicative of a pitch function specified by musical background of said musical note succession;

background input means for inputting musical background information; and pitch name adapting means for changing a pitch name of each said note data record from said music material storage means into an adapted pitch name based on pitch name and note type included in the note data record and said input musical background information to thereby make a pitch name succession adapted to the input musical background information.

2. The machine composer of claim 1 wherein said background input means comprises means for inputting, as said musical background information, a keynote, a note scale and a chord progression.

3. The machine composer of claim 1 wherein said background input means comprises means for selectively inputting, as said musical background information, (A) a keynote, a note scale and a chord progression, (B) a keynote and a note scale, or (C) a chord progression only.

4. The machine composer of claim 1 wherein said note type has been preselected from note types including chord tone, available note, tension note and avoid note.

5. The machine composer of claim 1 wherein said background input means comprises input means for selectively inputting, as said musical background information, one of:

(A) a plurality of features of musical background, and (B) a part of said plurality of features, and wherein said pitch name adapting means comprises:

pitch name candidate generating means for successively generating a plurality of different pitch name candidates, one at a time, based on a pitch name stored in said music material storage means;

note type identifying means for identifying a note type of a pitch name candidate from said pitch name candidate generating means based on said input musical background information;

first pitch name determining means operative when said plurality of features have been input for determining that said pitch name candidate is adapted on the condition that a first relation holds between said identified note type and said note type stored in said music material storage means;

second pitch name determining means operative when said part has been input for determining that said pitch name candidate is adapted on the condition that a second relation different from said first relation holds between said identified note type and said note type stored in said music material storage means; and next means operative when either said first or second pitch name determining means has found said pitch name candidate unadapted for requesting said pitch name candidate generating means to generate a next pitch name candidate.

6. The machine composer of claim 1 wherein said each note data record further includes a note-on time, a duration and a velocity.

7. The machine composer of claim 1 further comprising:

background storage means for storing keynote and scale information concerning said musical note succession stored in said musical material storage means; and substituting means for substituting said stored keynote and scale information when said input musical background information does not contain a keynote or a scale.

8. A machine composer for music comprising:

music material storage means for storing data of a musical note succession represented by a plurality of note data records in which each note data record representative of a musical note in said musical note succession includes at least a pitch name an a note type indicative of a musical note pitch function specified by musical background of said musical note succession;

background input means for inputting musical background information; and pitch name adapting means for changing a pitch name of each said note data record from said music material storage means into an adapted pitch name based on pitch name and note type included in the note data record and said input musical background information to thereby make a pitch name succession adapted to the input musical background information;

wherein said pitch name adapting mean comprises:

pitch name candidate generating means for successively generating a plurality of different pitch name candidates, one at a time, based on a pitch name stored in said musical storage means;

note type identifying means for identifying a note type of a pitch name candidate from said pitch candidate generating means based on said input musical background information;

comparing means for comparing said identified note type with a note type stored in said music material storage means; and pitch name determining means for determining whether said pitch name candidate is adapted based on results of said comparing and for requesting said pitch name candidate generating means to generate a next pitch name candidate when said pitch name candidate has been found unadapted.

9. The machine composer of claim 8 wherein said pitch name candidate generating means comprises:

pitch difference table storage means for storing a plurality of pitch differences that are successively readable; and computing means for using a pitch name from said music material storage means and pitch difference or differences from said pitch difference table storage means to thereby compute said pitch name candidate.

10. The machine composer of claim 9 wherein said computing means comprises:

motion determining means for determining a motion between said pitch name and a previous pitch name from said musical material storage means; and arithmetic means for selectively adding to or subtracting from said pitch name said pitch difference or differences from said pitch difference table depending on said determined motion to thereby generate said pitch name candidate.

11. The machine composer of claim 8 wherein said pitch name candidate generating means comprises:

a plurality of different pitch difference table storage means, each for storing a plurality of pitch differences that are successively readable;

selecting means for selecting a desired one of said plurality of different pitch difference table storage means; and computing means for using a pitch name from said music material storage means and pitch difference or differences from said selected pitch difference table storage means to thereby compute said pitch name candidate.

12. The machine composer of claim 8 wherein said pitch name candidate generating means comprises initial means for using a pitch name stored in said music material storage means as an initial pitch name candidate.

13. The machine composer of claim 8 wherein said pitch name candidate generating means comprises initial means for generating an initial pitch name candidate by adding to previous adapted pitch name a pitch interval from a previous to current pitch name stored in said musical material storage means.

14. The machine composer of claim 8 wherein said note type identifying means comprises:

chord tone pitch class set determining means for determining a chord tone pitch class set for a chord from said input musical background information;

tension note pitch class set determining means for determining a tension note pitch class set for said chord from said input musical background information;

scale note pitch class set determining means for determining a scale note pitch class set for a scale and keynote from said input musical background information; and matching means for matching a pitch class of said pitch name candidate against said determined chord tone pitch class set, said determined tension note pitch class set and said determined scale note pitch class set, respectively, to thereby identify said note type of said pitch name candidate as a function of said input musical background information.

15. The machine composer of claim 8 wherein said comparing means comprises:

priority assigning means for assigning unique priorities to different ones of a plurality of note types; and priority comparing means for comparing a priority assigned to said identified note type with a priority assigned to said note type stored in said music material storage means; and wherein said pitch name determining means comprises means for accepting said pitch name candidate as an adapted pitch name when said priority comparing means has found that said priority assigned to said identified note type is higher than or equal to said priority assigned to said note type stored in said music material storage means.

16. A machine composer for music comprising:

music material storage means for storing data of a musical note succession represented by a plurality of note data records in which each note data record representative of a musical note in said musical note succession includes at least a pitch name and a note type indicative of a pitch function specified by musical background of said musical note succession;

background input means for inputting musical background information; and pitch name adapting means for changing a pitch name of each said note data record from said music material storage means into an adapted pitch name based on pitch name and note type included in the note data record and said input musical background information to thereby make a pitch name succession adapted to the input musical background information;

wherein said pitch name adapting means comprises:

pitch name candidate generating means for successively generating a plurality of different pitch name candidates, one at a time, based on a pitch name stored in said music material storage means;

note type identifying means for identifying a note type of a pitch name candidate from said pitch name candidate generating means based on said input musical background information;

first pitch name determining means operative when said background input means has input (A) a keynote, a note scale and a chord progression, as said musical background information, for selectively determining that said pitch name candidate is adapted on the condition that a first relation holds between said identified note type and said note type stored in said music material storage means;

second pitch name determining means operative when said background input means has input (B) a keynote and a note scale, as said musical background information, for selectively determining that said pitch name candidate is adapted on the condition that a second relation different from said first relation holds between said identified note type and said note type stored in said music material storage means;

third pitch name determining means operative when said background input means has input (C) a chord progression only, as said musical background information, for selectively determining that said pitch name candidate is adapted on the condition that a third relation different from either of said first and second relations holds between said identified note type and said note type stored in said music material storage means; and next means operative when said first, second or third pitch name determining means has found said pitch name candidate unadapted for requesting said pitch name candidate generating means to generate a next pitch name candidate.

17. A machine composer for music comprising:

music material storage means for storing data of a musical note succession represented by a plurality of note data records in which each note data record representative of a musical note in said musical note succession includes at least a pitch name and a note type indicative of a pitch function specified by musical background of said musical note succession;

background input means for inputting musical background information; and pitch name adapting means for changing a pitch name of each said note data record from said music material storage means into an adapted pitch name based on pitch name and note type included in the note data record and said input musical background information to thereby make such a pitch name succession that is adapted to said input musical background information and as close as possible an original pitch name succession constituted by pitch names of said plurality of note data records.

18. A machine composer for music comprising:

music material storage means for storing data of a musical note succession represented by a plurality of note data records in which each note data record representative of a musical note in said musical note succession includes at least a pitch name and a note type indicative of a pitch function specified by musical background of said musical note succession;

background input means for inputting musical background information; and pitch name adapting means for changing a pitch name of each said note data record from said music material storage means into an adapted pitch name based on pitch name and note type included in the note data record and said input musical background information to thereby make such a pitch name succession that is adapted to said input musical background information and has a pitch name difference succession as close as possible to a pitch name difference succession of an original pitch name succession constituted by pitch names of said plurality of note data records.

* * * * *

UNITED STATES PATENT AND TRADEMARK OFFICE

CERTIFICATE OF CORRECTION

PATENT NO. : 5,705,761

DATED : January 6, 1998

INVENTOR(S) : MINAMITAKA et al.

It is certified that error appears in the above-identified patent and that said Letters Patent is hereby corrected as shown below:

Column 17, line 22 (claim 8, line 6), "an" should be --and--.

Signed and Sealed this

Twenty-seventh Day of April, 1999

*Attest:*

Q. TODD DICKINSON

*Attesting Officer*

*Acting Commissioner of Patents and Trademarks*